US010351310B2

(12) United States Patent
Allers

(10) Patent No.: US 10,351,310 B2
(45) **Date of Patent: *Jul. 16, 2019**

(54) TAMPER-EVIDENT CONTAINER WITH A BUMP NEAR A TABBED HINGE

(71) Applicant: Genpak, LLC, Charlotte, NC (US)

(72) Inventor: Brian S. Allers, Fort Mill, SC (US)

(73) Assignee: Genpak, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/797,313

(22) Filed: Oct. 30, 2017

(65) Prior Publication Data

US 2018/0118421 A1 May 3, 2018

Related U.S. Application Data

(63) Continuation-in-part of application No. 15/338,145, filed on Oct. 28, 2016, now Pat. No. 10,220,985.

(51) Int. Cl.
*B65D 43/02* (2006.01)

(52) U.S. Cl.
CPC ..... *B65D 43/0254* (2013.01); *B65D 43/0256* (2013.01); *B65D 2101/0092* (2013.01); *B65D 2543/00194* (2013.01); *B65D 2543/00685* (2013.01); *B65D 2543/00796* (2013.01); *B65D 2543/00842* (2013.01)

(58) Field of Classification Search
CPC .. B65D 2543/00796; B65D 2251/1025; B65D 43/0235; B65D 55/06
See application file for complete search history.

(56) References Cited

U.S. PATENT DOCUMENTS

| | | | |
|---|---|---|---|
| 2,915,214 | A | 12/1959 | Morris |
| 3,572,579 | A | 3/1971 | Mueller et al. |
| 3,674,295 | A | 7/1972 | Padovani |
| D225,050 | S | 11/1972 | Cannell |
| 3,773,207 | A | 11/1973 | Dokoupil et al. |
| 3,794,090 | A | 2/1974 | Commisso |
| 3,902,621 | A | 9/1975 | Hidding |
| 4,006,839 | A | 2/1977 | Thiel et al. |

(Continued)

FOREIGN PATENT DOCUMENTS

| | | |
|---|---|---|
| AU | 200502314 | 12/2005 |
| AU | 2009100625 | 8/2009 |

(Continued)

OTHER PUBLICATIONS

U.S. Appl. No. 15/338,145, Restriction Requirement dated Mar. 15, 2018.

(Continued)

*Primary Examiner* — Shawn M Braden
(74) *Attorney, Agent, or Firm* — Laurence & Phillips IP Law

(57) ABSTRACT

A tamper-evident container includes a base and a lid. A base extension and a lid extension are connected to a hinge to join the base and the lid together in a closed, pre-use configuration. A tab extends from either the lid extension or the base extension in a direction away from the lid and the base such that the tab extends beyond the hinge. The tab is joined to one of the extensions via weakened regions that can be torn when the tab is pulled to indicate that the container has been tampered with or opened.

26 Claims, 23 Drawing Sheets

(56) References Cited

U.S. PATENT DOCUMENTS 4,091,930 A 5/1978 Buchner et al.
4,113,136 A 9/1978 Abbott
4,300,700 A 11/1981 Chang
4,362,252 A 12/1982 Graff
4,433,793 A 2/1984 Ingemann
4,434,907 A 3/1984 Ingemann
4,535,889 A 8/1985 Terauds
4,576,330 A 3/1986 Schepp
4,627,550 A 12/1986 Dines
4,742,935 A 5/1988 Schellenberg
4,747,510 A 5/1988 MacK
4,759,463 A 7/1988 Mazoin
RE32,739 E 8/1988 Terauds
4,765,463 A 8/1988 Chanel
4,804,092 A 2/1989 Jones
4,881,656 A 11/1989 Chumley et al.
4,890,758 A 1/1990 Gailus
4,930,656 A 6/1990 Blanchette
4,966,292 A 10/1990 Marino
4,998,622 A 3/1991 Drack
5,002,198 A 3/1991 Smith
5,007,231 A 4/1991 Ingemann
5,027,969 A 7/1991 Lesquir
5,038,937 A 8/1991 DiSesa
5,040,695 A 8/1991 Adams et al.
5,046,659 A 9/1991 Warburton
5,052,574 A 10/1991 McKinnon et al.
5,111,953 A 5/1992 Faust et al.
5,111,954 A 5/1992 Gaudreault
5,115,934 A 5/1992 Nelson
5,129,531 A 7/1992 Beck et al.
5,133,470 A 7/1992 Abrams et al.
5,163,575 A 11/1992 Luch et al.
5,169,014 A 12/1992 Hexamer
5,170,905 A 12/1992 Luch
5,219,074 A 6/1993 Mizuno et al.
5,219,087 A 6/1993 Christensson
5,249,694 A 10/1993 Nelson
5,287,959 A 2/1994 Hansen et al.
5,307,948 A 5/1994 Blackburn et al.
5,322,178 A 6/1994 Foos
D352,000 S 11/1994 Hansen et al.
5,405,009 A 4/1995 Hackenbracht
5,421,473 A 6/1995 McCrossen
D360,808 S 8/1995 Meier et al.
5,507,405 A 4/1996 Thomas et al.
5,507,406 A 4/1996 Urciuoli et al.
5,511,679 A 4/1996 Beck
5,528,814 A 6/1996 Luch et al.
5,545,375 A 8/1996 Tropsha et al.
5,573,134 A 11/1996 Chenault et al.
5,584,408 A 12/1996 Orkisz
5,607,075 A 3/1997 Burgdorf et al.
5,683,771 A 11/1997 Tropsha
5,699,913 A 12/1997 Richardson
5,842,593 A 12/1998 Holdt
5,875,913 A 3/1999 Letica
5,897,011 A 4/1999 Brilliant et al.
5,931,332 A 8/1999 Mygatt et al.
5,938,068 A 8/1999 Atkins et al.
5,979,687 A 11/1999 Hayes et al.
5,979,690 A 11/1999 Hartley
5,984,130 A 11/1999 Hayes et al.
6,000,570 A 12/1999 Nelson
RE36,729 E 6/2000 Luch et al.
6,116,501 A 9/2000 Hupp
6,135,304 A 10/2000 Wyslotsky
6,168,044 B1 1/2001 Zettle et al.
6,257,435 B1 7/2001 Chedister et al.
6,279,774 B1 8/2001 Clute et al.
6,564,958 B1 5/2003 Ramsey et al.
6,572,909 B1 6/2003 Bagwell et al.
6,604,645 B1 8/2003 Vaupotic
D484,749 S 1/2004 Garraway
6,772,901 B2 8/2004 Witt
6,918,506 B2 7/2005 Ramirez et al.
6,926,165 B2 8/2005 Conti
7,004,341 B2 2/2006 Shenkar et al.
7,073,680 B2 7/2006 Boback et al.
7,097,058 B2 8/2006 Wellman et al.
7,118,003 B2 10/2006 Sellari et al.
7,207,457 B2 4/2007 Schwarz
7,243,813 B2 7/2007 Krueger
7,284,673 B2 10/2007 Habeger et al.
D556,569 S 12/2007 Stein et al.
7,311,218 B2 12/2007 Varadarajan
D569,243 S 5/2008 Kidd et al.
7,434,777 B2 10/2008 Swannell et al.
D593,369 S 6/2009 Green et al.
7,568,589 B2 8/2009 Vovan
D601,013 S 9/2009 Petitjean
7,597,206 B2 10/2009 Atkins et al.
D605,936 S 12/2009 Durdon et al.
7,631,776 B2 12/2009 Vovan et al.
7,712,626 B2 5/2010 Vovan
D637,481 S 5/2011 Sellari et al.
D640,547 S 6/2011 Guillemin et al.
7,992,743 B2 8/2011 Vovan
D646,563 S 10/2011 Bontrager et al.
8,028,851 B2 10/2011 Vovan et al.
8,091,731 B2 1/2012 Kidd et al.
8,251,249 B1 8/2012 Vovan
8,360,262 B2 1/2013 Vovan
8,608,008 B2 12/2013 Gingras et al.
D697,795 S 1/2014 Garza
8,757,416 B2 6/2014 Golota et al.
8,833,589 B2 9/2014 Vovan
8,939,307 B2 1/2015 Gingras et al.
8,944,270 B2 2/2015 Bontrager et al.
9,016,503 B2 4/2015 Barbier et al.
9,102,446 B2 8/2015 Kowal et al.
9,132,942 B2 9/2015 Nikaein
9,365,331 B2 6/2016 Gingras et al.
9,409,683 B2 8/2016 Gingras et al.
9,624,009 B2 4/2017 Gingras et al.
2003/0052133 A1 3/2003 Hayes et al.
2003/0160051 A1 8/2003 Ciccone
2003/0189048 A1 10/2003 Luburic
2004/0118848 A1 6/2004 Marshall
2004/0134910 A1 7/2004 Colombo
2005/0161455 A1 7/2005 Studee
2006/0060578 A1 3/2006 Church et al.
2006/0163265 A1 7/2006 Candido
2006/0201946 A1 9/2006 Witt
2006/0255054 A1 11/2006 Vovan
2006/0261070 A1 11/2006 Robertson et al.
2006/0266750 A1 11/2006 Lesquir
2006/0278652 A1 12/2006 Vovan et al.
2006/0289541 A1 12/2006 Boback et al.
2006/0289549 A1 12/2006 Vovan
2007/0012710 A1 1/2007 Vovan
2007/0045317 A1 3/2007 Rosender et al.
2007/0062948 A1 3/2007 Albrecht et al.
2007/0062949 A1 3/2007 Bordner
2007/0108210 A1 5/2007 Alvares et al.
2007/0138046 A1 6/2007 Vovan
2007/0138180 A1 6/2007 Vovan
2007/0196541 A1 8/2007 Vovan et al.
2007/0202221 A1 8/2007 Hinze et al.
2008/0000904 A1 1/2008 Vovan
2008/0006632 A1 1/2008 Vovan
2008/0087669 A2 4/2008 Boback et al.
2008/0185383 A1 8/2008 Philippe et al.
2008/0308557 A1 12/2008 Kyle et al.
2009/0021026 A1 1/2009 Collier
2009/0057313 A1 3/2009 Alvares
2009/0090712 A1 4/2009 Vovan
2009/0120937 A1 5/2009 Vovan
2009/0120942 A1 5/2009 Vovan
2009/0206082 A1* 8/2009 Vovan ..... B65D 43/0249 220/266
2009/0223619 A1 9/2009 Vovan
2010/0051620 A1 3/2010 Parikh et al.
2010/0072217 A1 3/2010 Parikh et al.

(56) References Cited

U.S. PATENT DOCUMENTS

| | | | |
|---|---|---|---|
| 2010/0084401 | A1 | 4/2010 | Golota et al. |
| 2010/0102074 | A1 | 4/2010 | Parikh et al. |
| 2012/0005994 | A1 | 1/2012 | Tidball et al. |
| 2012/0048774 | A1 | 3/2012 | Gingras et al. |
| 2013/0043247 | A1 | 2/2013 | Nikaein |
| 2013/0168394 | A1 | 7/2013 | Messier |
| 2013/0320015 | A1 | 12/2013 | Dyble et al. |
| 2014/0138383 | A1 | 5/2014 | Lisowy et al. |
| 2014/0224803 | A1 | 8/2014 | Pickering |
| 2014/0284346 | A1 | 9/2014 | McCumber |
| 2015/0060455 | A1 | 3/2015 | Chou |
| 2015/0266611 | A1 | 9/2015 | Dow et al. |

FOREIGN PATENT DOCUMENTS

| | | | |
|---|---|---|---|
| BE | 1017894 | | 10/2009 |
| DE | 7816353 | U1 | 11/1978 |
| DE | 4418935 | C2 | 2/1997 |
| DE | 1999083197 | | 8/1999 |
| DE | 29914659 | U1 | 12/1999 |
| EP | 0752374 | B1 | 12/1997 |
| EP | 1336569 | A2 | 8/2003 |
| EP | 2030908 | A1 | 3/2009 |
| EP | 2210819 | A1 | 7/2010 |
| FR | 2494175 | A1 | 5/1982 |
| FR | 2622535 | A1 | 5/1989 |
| FR | 2691952 | A1 | 12/1993 |
| FR | 2779126 | A1 | 12/1999 |
| FR | 2819496 | B1 | 4/2003 |
| FR | 2903970 | A1 | 1/2008 |
| FR | 2907102 | A1 | 4/2008 |
| GB | 2195318 | A | 4/1988 |
| GB | 2219284 | A | 12/1989 |
| GB | 2227481 | A | 8/1990 |
| GB | 2234741 | A | 2/1991 |
| GB | 2257118 | A | 1/1993 |
| GB | 2278838 | A | 12/1994 |
| GB | 2306160 | A | 4/1997 |
| GB | 2412651 | A | 10/2005 |
| WO | 9525675 | | 9/1995 |
| WO | 2005009857 | A1 | 2/2005 |

OTHER PUBLICATIONS

U.S. Appl. No. 15/338,145, Response to Restriction Requirement dated Jun. 15, 2018.
U.S. Appl. No. 15/338,145, Amendment dated Aug. 8, 2018.
U.S. Appl. No. 15/338,145, Rejection dated Sep. 6, 2018.
U.S. Appl. No. 15/338,145, Response dated Sep. 7, 2018.
U.S. Appl. No. 15/338,145, Notice of Allowance dated Dec. 10, 2018.

* cited by examiner

TAMPER-EVIDENT CONTAINER WITH A BUMP NEAR A TABBED HINGE

RELATED APPLICATION

This application is a continuation-in-part application of U.S. patent application Ser. No. 15/338,145 titled TAMPER-EVIDENT CONTAINER WITH A TABBED HINGE, which was filed on Oct. 28, 2016. Priority is claimed to application Ser. No. 15/338,145 and application Ser. No. 15/338,145 is incorporated herein by reference.

FIELD OF THE INVENTION

The present disclosure relates to tamper-evident containers.

BRIEF DESCRIPTION OF THE DRAWINGS

The written disclosure herein describes illustrative embodiments that are non-limiting and non-exhaustive. Reference is made to certain of such illustrative embodiments that are depicted in the figures, as listed below.

Figure 1A:
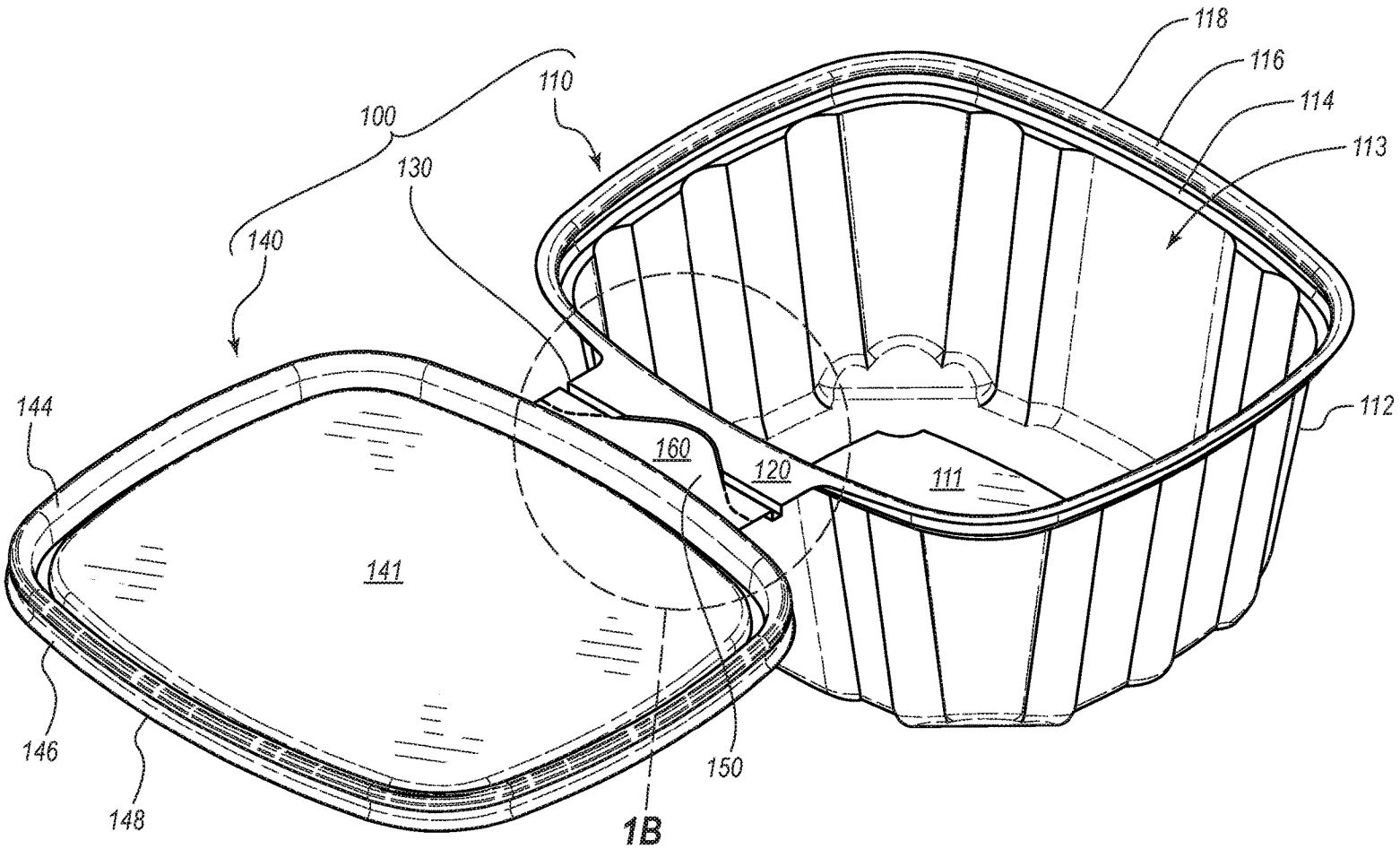
FIG. 1A is a perspective view of an embodiment of a tamper-evident container in an open configuration showing a hinge with two fold lines.

It should be noted that these figures are intended to illustrate the general characteristics of methods, structure and/or materials utilized in certain exemplary embodiments and to supplement the written description provided below. These drawings are not, however, to scale and may not precisely reflect the precise structural or performance characteristics of any given embodiment, and should not be interpreted as defining or limiting the range of values or properties encompassed by exemplary embodiments. For example, the relative thicknesses and positioning of components may be reduced or exaggerated for clarity. The use of similar or identical reference numbers in the various drawings is intended to indicate the presence of a similar or identical element or feature.

DETAILED DESCRIPTION OF THE PREFERRED EMBODIMENTS

The inventive concepts will now be described more fully hereinafter with reference to the accompanying drawings, in which exemplary embodiments of the inventive concepts are shown. The advantages and features of the inventive concepts and methods of achieving them will be apparent from the following exemplary embodiments that will be described in more detail with reference to the accompanying drawings. It should be noted, however, that the inventive concepts are not limited to the following exemplary embodiments, and may be implemented in various forms. Accordingly, the exemplary embodiments are provided only to disclose the inventive concepts and let those skilled in the art know the category of the inventive concepts. In the drawings, embodiments of the inventive concepts are not limited to the specific examples provided herein and are exaggerated for clarity. The same reference numerals or the same reference designators denote the same elements throughout the specification.

The terminology used herein is for the purpose of describing particular embodiments only and is not intended to limit the invention. As used herein, the singular terms "a," "an" and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including", when used herein, specify the presence of stated features, integers, steps, operations, elements, and/or components, but do not preclude the presence or addition of one or more other features, integers, steps, operations, elements, components, and/or groups thereof.

Moreover, exemplary embodiments are described herein with reference to cross-sectional views, perspective views, and/or top or plan views that are idealized exemplary views. In the drawings, the thicknesses of some features may be exaggerated for clarity. Accordingly, variations from the shapes of the illustrations as a result, for example, of manufacturing techniques and/or tolerances, are to be expected. Thus, exemplary embodiments should not be construed as limited to the shapes of regions illustrated herein but are to include deviations in shapes that result, for example, from manufacturing. For example, an edge may be illustrated with sharp ends and without rounded or curved features even though such rounded or curved features may be preferable. Thus, the regions or elements illustrated in the figures are schematic in nature and their shapes are not intended to illustrate the actual shape of a region or an element of a container and are not intended to limit the scope of example embodiments.

The embodiments disclosed herein relate to containers that may be used, for example, in the food industry. In particular, certain embodiments disclosed herein relate to tamper-evident containers that may be used for storing and/or transporting food products.

Figure 1B:
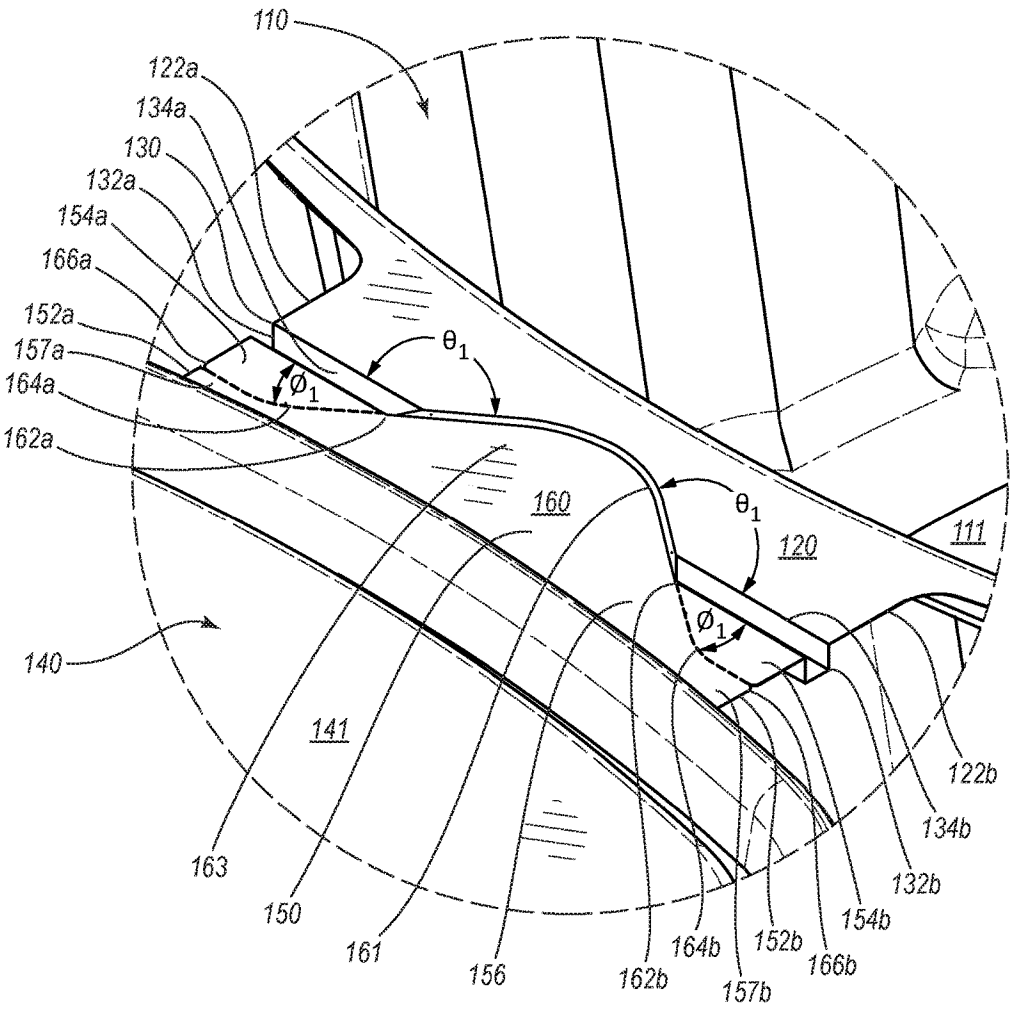
FIG. 1B is an enlarged perspective view of the section encircled at 2 of the tamper-evident container of FIG. 1A.

Certain embodiments can advantageously be supplied to an intermediary user in an open, preloading configuration (e.g., FIG. 1A). The intermediary user can load the container with any desired item, such as a food product, and can then close the container into a closed, pre-use configuration (e.g., FIG. 1C). When in this state, the container can be resistant to opening at any region other than at the hinge, which is provided with a tamper-evident tab. Accordingly, in some embodiments, an end user can ultimately access the packaged contents of the container using the tamper-evident tab. The tab can be pulled to assist in separating primary components of the container (e.g., a lid and a base) from each other. The tab can remain coupled with one of the primary components of the container (e.g., the lid), but can be separated from the other primary component such as the base to indicate that the tab has been used (e.g., FIG. 1E). After the tab has been fully pulled to detach the lid from the base, the container can be closed again by sealing the lid and base together in a closed, post-use configuration (e.g., FIG. 1F). Further details of embodiments of tamper-evident containers are provided below.

FIGS. 1A-1G show a container 100 with several primary components or elements including a base 110, a hinge 130, a lid 140, and a tab 160. Other embodiments of a tamper-evident container are described with reference to FIGS. 2-8B. In particular, container 100' is shown in FIG. 2, container 100" in FIG. 3, container 200 in FIGS. 4A-4B, container 200' in FIGS. 5A-5C, container 300 in FIGS. 6A-6D, container 300' in FIGS. 7A-7C, and container 300" in FIGS. 8A-8B. The containers may have any suitable shapes such as those that are round, oval, rectangular, and irregular shapes. Additionally, the containers may have any suitable size. For example, the containers may hold volumes ranging from 4 ounces through 64 ounces.

FIG. 1A depicts an embodiment of a tamper-evident container 100 shown in an open, preloading configuration. As illustrated in FIGS. 1A-1D, the base 110 and the lid 140 are connected or otherwise adjoined to one another. For example, the base 110 and the lid 140 may be connected via a hinged portion or hinge 130. In some embodiments, the base 110, the lid 140, and the hinge 130 may be integrally formed from a unitary piece of material. For example, in some embodiments the container 100 is formed from a single piece or sheet of thermoformed plastic. Examples of suitable plastic materials include polyethylene terephthalate (PET) and polypropylene.

Figure 1C:
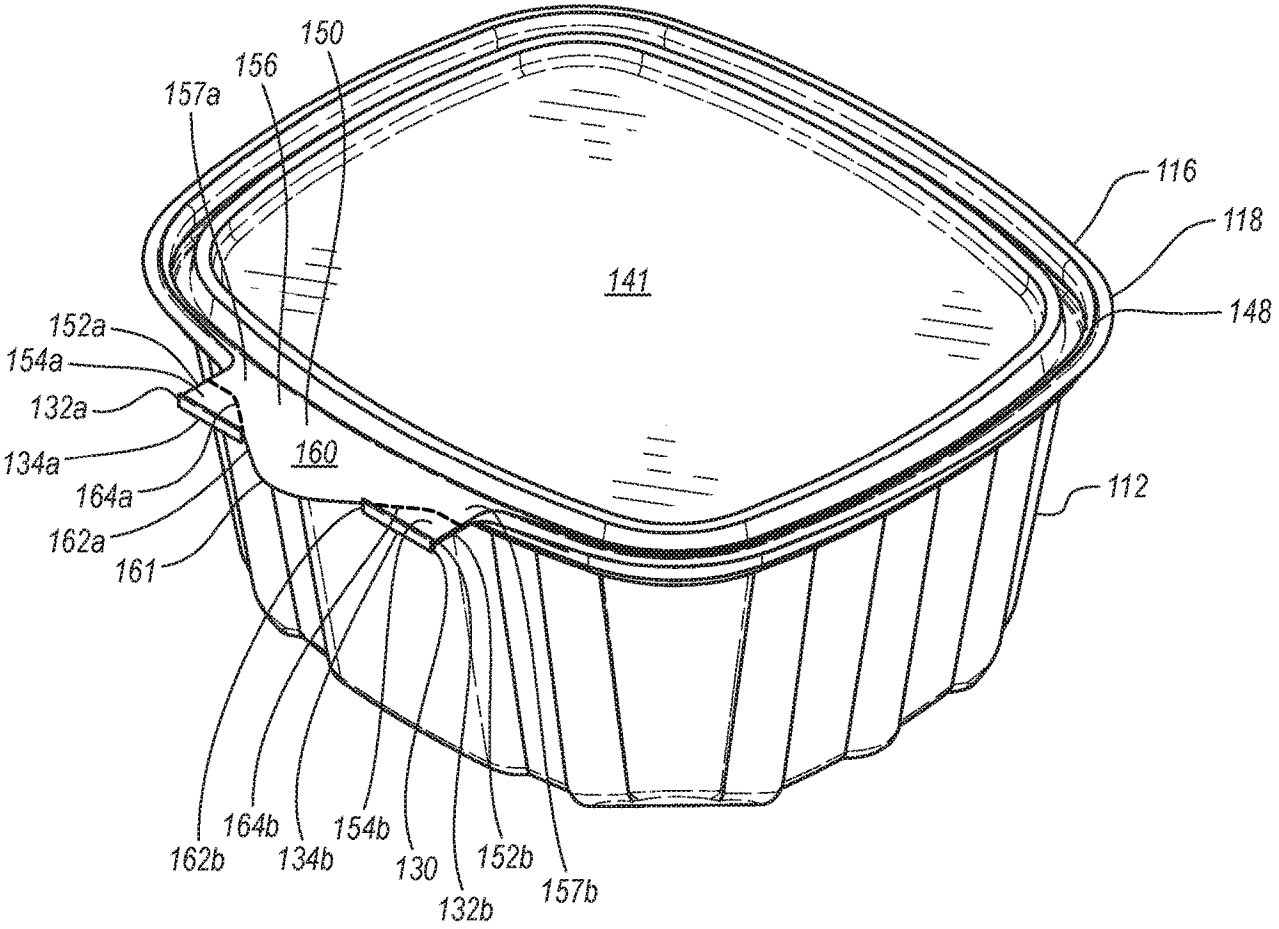
FIG. 1C is a perspective view of the tamper-evident container of FIG. 1 in a closed, pre-use configuration.
Figure 1D:
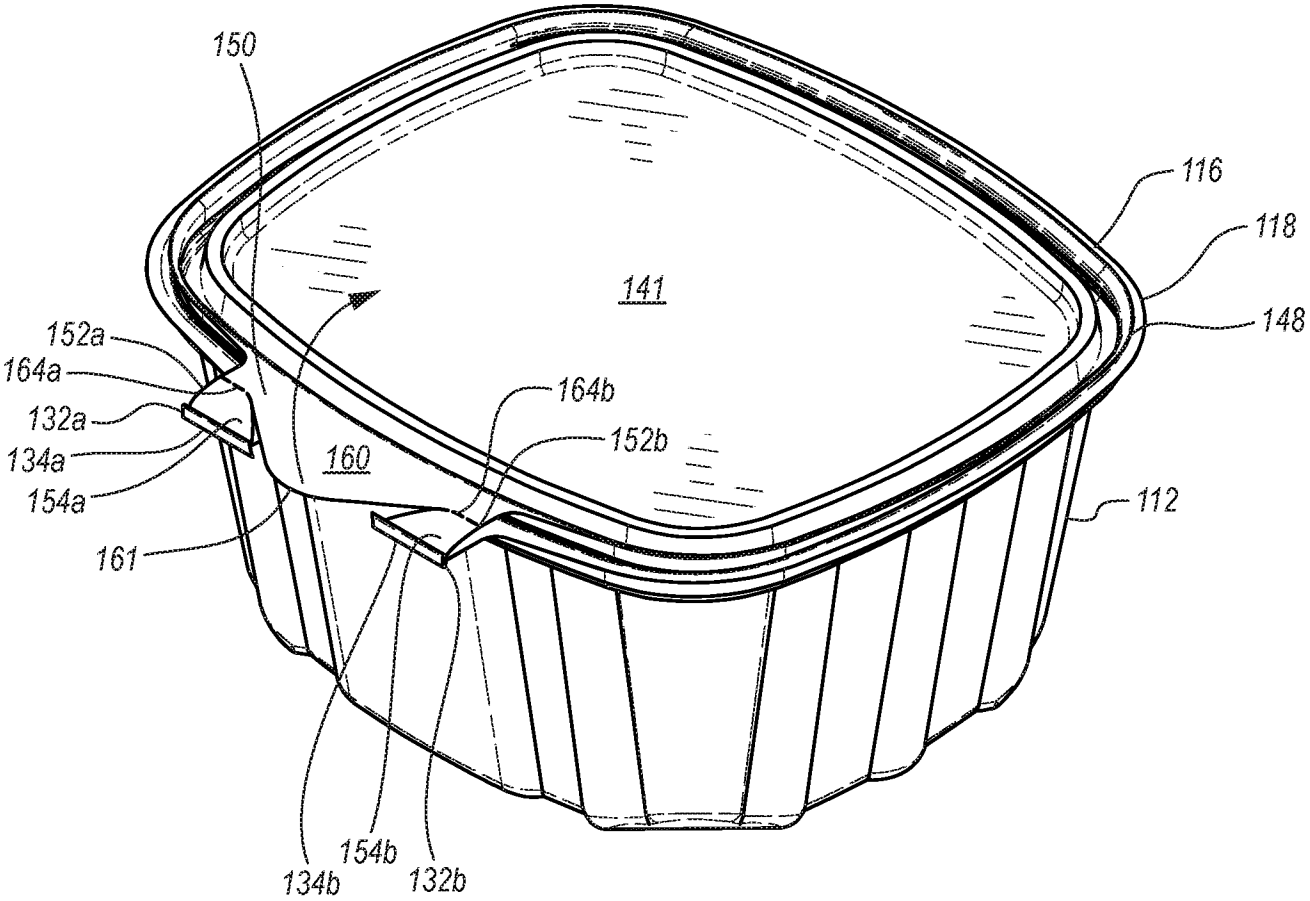
FIG. 1D is a perspective view of the tamper-evident container of FIG. 1 with the tab partially pulled away from the lid extension along the weakened regions.
Figure 1E:
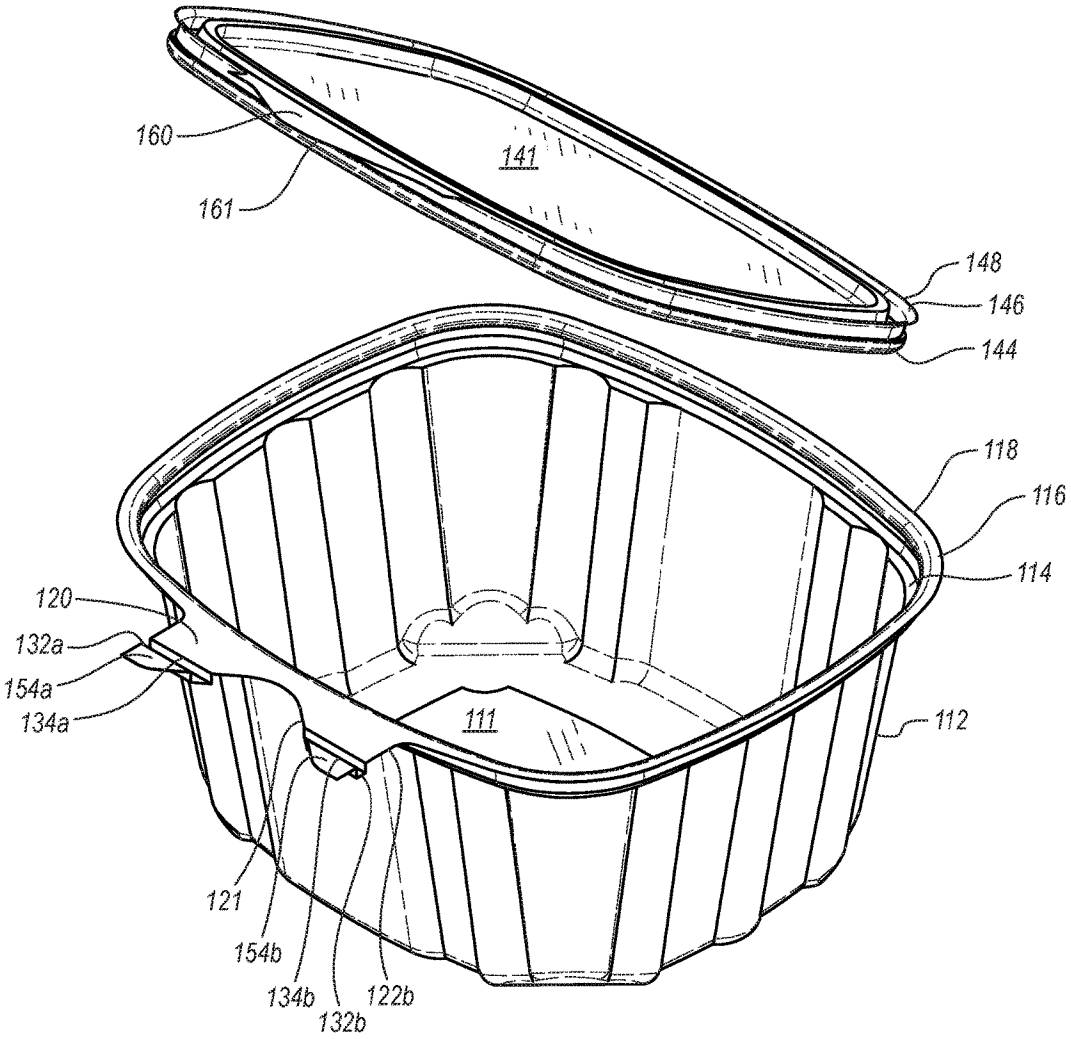
FIG. 1E is a perspective view of the tamper-evident container of FIG. 1 in an open configuration after the tab has been pulled away from the lid extension along the weakened regions such that that the lid is detached from the base.
Figure 2:
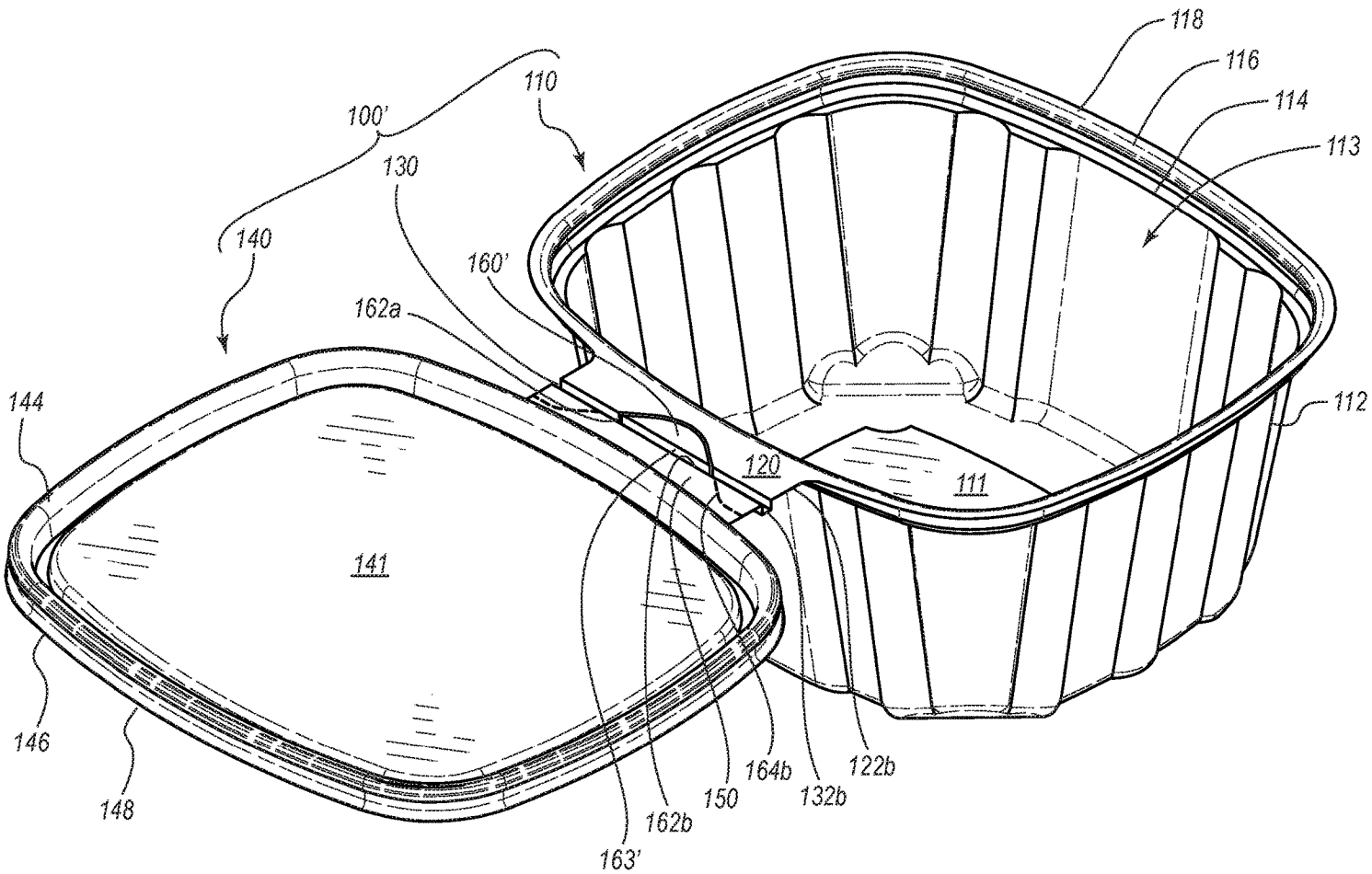
FIG. 2 is a perspective view of another embodiment of a tamper-evident container in an open configuration that differs from the embodiment shown in FIG. 1 based on the configuration of the tab.

FIG. 1C depicts the tamper-evident container 100 with the hinge 130 folded such that lid 140 is closed on the base 110 after an initial filling of the base 110, but the lid 140 has not yet been uncoupled from the base 110, as evidenced by the fact that the weakened regions 164*a-b* are unbroken. In FIG. 1D, portions of the weakened regions 164*a-b* remain intact but some tearing has occurred as the tab is pulled upward. Continued pulling on tab 160 results in complete tearing of weakened regions 164*a-b* to separate the tab 160 along the weakened regions 164*a-b* such that the container transitions out of the closed pre-use configuration to the open configuration shown in FIG. 1E. Tearing of the weakened regions 164*a-b* indicates that the lid 140 may have been uncoupled from the base 110 such that a user can see that the contents of the container may have been tampered with or otherwise accessed. This provides a user such as a consumer with a tamper-evident indication. The tearing does not occur in a coaxial configuration with hinge 130.

The base 110 includes a base extension 120, which connects the base 110 to the hinge 130. The lid 140 includes a lid extension 150, which connects the lid 140 to the hinge 130. The configuration of the hinge 130 and the tab 160 are discussed in greater detail below after introducing various elements of the base 110 and the lid 140.

As shown in FIG. 1A, the base 110 may include a bottom end 111. The bottom end 111 can have any suitable shape and configuration. For example, in some embodiments at least a portion of the bottom end 111 is substantially planar. In the illustrated embodiment, the bottom end 111 includes a raised platform surrounded by a recessed perimeter. The recessed perimeter has a contact surface on the outside of the base and at least a portion of the contact surface may be substantially planar such that the base 110 may readily rest upon a planar surface. The raised platform may be upwardly offset relative to the contact surface.

Figure 4A:
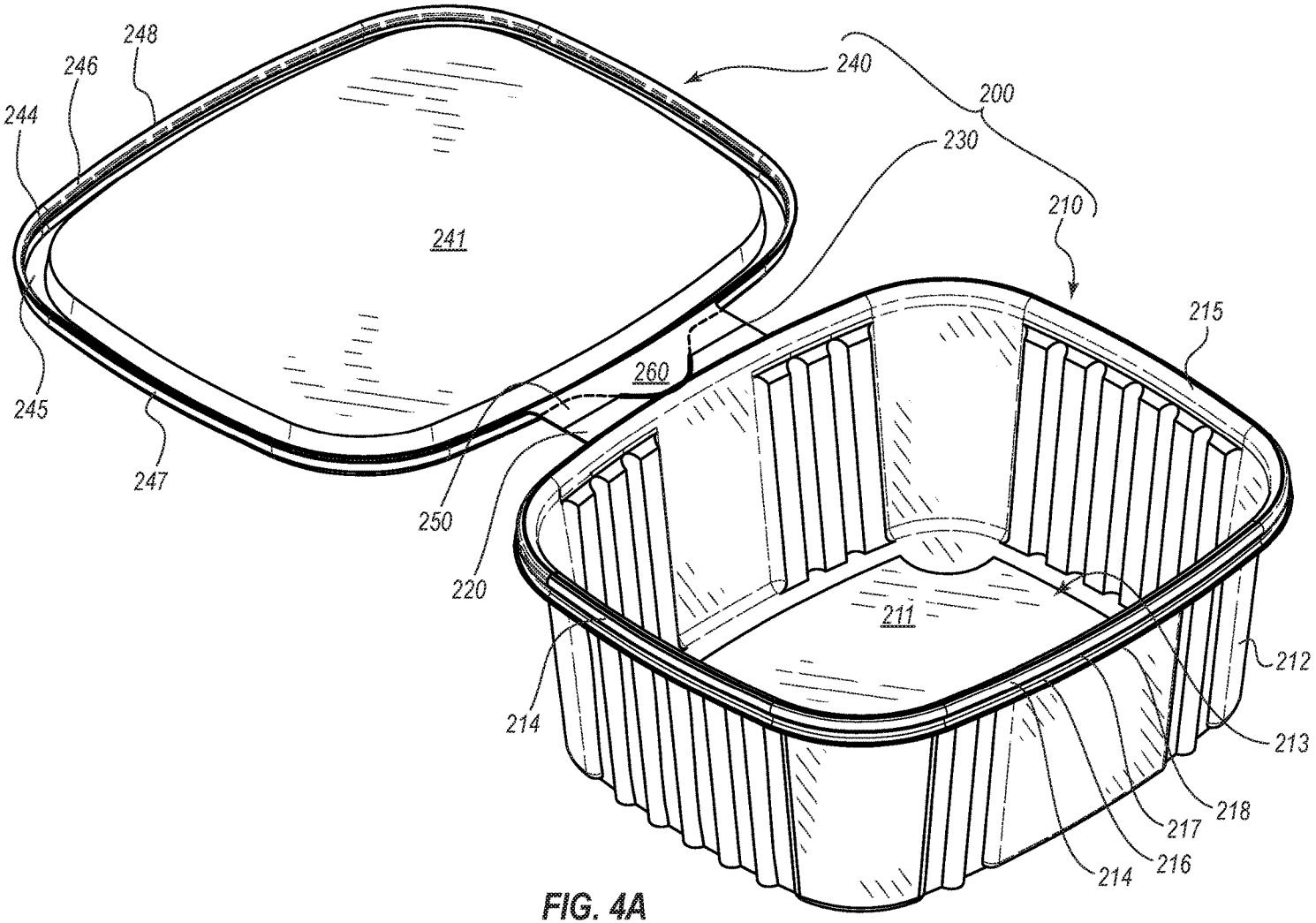
FIG. 4A is a perspective view of an additional embodiment of a tamper-evident container in an open configuration showing a hinge with a single, non-weakened fold line.
Figure 4B:
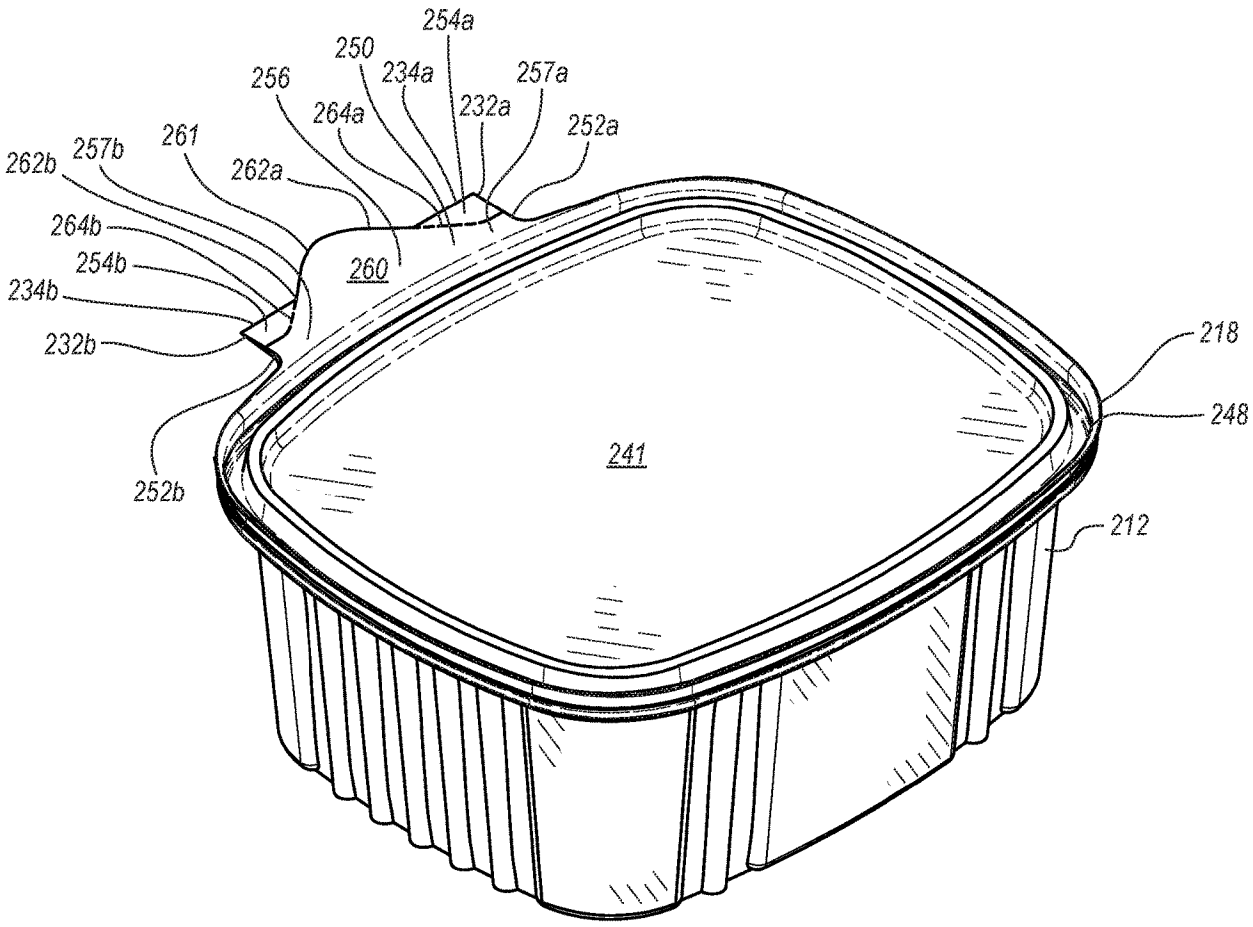
FIG. 4B is a perspective view of the tamper-evident container of FIG. 4A in a closed, pre-use configuration.

The base 110 may be generally bowl-shaped, although other shapes and configurations are possible such as base 210 that is relatively shallow compared with base 110 as shown in FIGS. 4A-4B. The base 110 may further include a sidewall 112 that extends upwardly from the bottom end 111. The bottom end 111 and the sidewall 112 can cooperate to define a cavity 113. When the container 100 is in a closed configuration, the lid 140 and the base 110 may be coupled or otherwise attached such that the cavity 113 defined by the base 110 is closed by the lid 140, or stated otherwise, is enclosed by the lid 140 and the base 110.

In some embodiments, the sidewall 112 may extend upwardly in a substantially vertical manner that it is substantially perpendicular to the bottom end 111. In other embodiments, the sidewall 112 may extend upwardly and may be angled radially outwardly. For example, the sidewall 112 may extend upwardly in a radially outward direction at an angle of about 5 degrees to about 15 degrees, or from about 5 degrees to about 10 degrees. In yet other embodiments, the sidewall 112 may extent upwardly in a curved or arcuate manner. Accordingly, as can be appreciated, the sidewall 112 may extend upwardly in a variety of ways depending on the desired shape and characteristics of the container 100.

The sidewall 112 may be substantially uniform or flat, or it may comprise one or more features for reinforcement, grip assistance, etc. For example, in the illustrated embodiment, the sidewall 112 comprises a plurality of substantially vertically oriented ribs. The ribs may provide the base 110 with strength and/or may augment its rigidity.

The base 110 of the container 100 may further comprise a base connection interface 114 disposed at an upper end of the sidewall 112. The base connection interface 114 may be configured to interact with a portion the lid 140 so as to close the container 100, as further discussed below. In some embodiments, the base connection interface 114 may extend about an entirety of the periphery of the sidewall 112, as in the depicted embodiments. In other embodiments, the base connection interface 114 may extend about at least a majority of a periphery of the sidewall 112. For example, in various embodiments, the base connection interface 114 may extend about at least ½, ⅔, or ¾ of a total periphery of the upper end of the sidewall 112. In yet other embodiments, the base connection interface 114 may extend around a smaller portion of the sidewall 112.

A base flange 116 can extend outwardly relative to the base connection interface 114. The base flange 116 may be directly connected to or otherwise coupled with an upper end of the base connection interface 114. Accordingly, the base flange 116 may be configured such that it is at a higher position than is base connection interface 114, as compared with to the bottom end 111. As shown in FIG. 1A, the base flange 116 is positioned at an upper end of the base connection interface 114, and the base flange 116 extends radially outwardly in a horizontal direction from the base connection interface 114. In other embodiments, the base flange 116 may be at about the same height, or may be lower than, the connection interface 114 relative to the bottom end 111.

At least a portion of the base flange 116 can be flat or planer. For example, in the illustrated embodiment, the base flange 116 defines a plane that is parallel to the plane defined by the bottom end 111. The planar portion of the base flange 116 may extend about at least a majority of the perimeter of the base. In some embodiments, at least a majority of the base flange 116 may be substantially planar. In yet other embodiments, only a portion of the base flange 116 may be substantially planar.

In other embodiments, the base flange 116 may have configurations that are non-planar and/or multi-planar. For example, the base flange 116 may extend upwardly at an angle relative to a horizontal plane (e.g., at an angle no less than about 30, 45, 60, or 75 degrees). Depending on the shape of the container, the base flange 116 may have substantially planar regions, substantially conical regions, and or regions that define other shapes. For example, where the base flange 116 extends upwardly at a constant angle along the periphery of the container 100 at each radial position, and the container is substantially rectangular, the upwardly extending flange 116 may define a different plane along each of the linear regions of the rectangle, and the flange 116 may define substantially conical regions at the corners that connect adjacent planar regions. As another example, where the base flange 116 extends upwardly at a constant angle along the periphery of the container 100 at each radial position, and the container is substantially circular, the flange 116 may define a substantially conical region that extends about at least a majority of the periphery of the base 110.

The base flange 116 may further comprise a free edge 118 that defines at least a portion of the outermost perimeter of the base 110. In some embodiments, the free edge 118 may extend about at least a majority of the outermost periphery of the sidewall 112. In the illustrated embodiment, for example, the free edge 118 extends about the outermost periphery of the sidewall 112 everywhere other than at the base extension 120. In other embodiments, the free edge 118 may extend about the entirety of the outermost periphery of the sidewall 112. The free edge 118 of the base flange 116 may therefore extend about at least a majority, up to and including the entirety, of the outermost perimeter of the base 110.

As shown in FIG. 1A, the lid 140 may include a top end 141. The top end 141 can have any suitable shape and configuration. For example, in some embodiments at least a portion of the top end 141 is substantially planar. The top end 141 can engage the top ends of the ribs of the sidewall 112 of the base to provide additional dimensional stability to the container.

The lid 140 can include a lid connection interface 144 that is configured to interact with a complementary or otherwise cooperative portion of the base 110. For example, the lid connection interface 144 may be configured to selectively couple with the base connection interface 114. After the container 100 has been transitioned to the open post-use configuration, it may be closed again, and thereby transitioned to a closed post-use configuration. For example, the connection interfaces 114, 144 and the base 110 and the lid 140, respectively, can be configured to repeatedly engage with each other and disengage from each other. In some embodiments, the connection interfaces 114, 144 are complementary in shape (see FIG. 1A and FIG. 1G), and the lid connection interface 144 and the base connection interface 114 may be substantially the same shape, size and conformation. In some embodiments, the lid connection interface 144 may be configured to be received by the base connection interface 114, and it may be slightly larger than the base connection interface 114 to assist in providing a tight seal therewith. In other embodiments, the base connection interface 114 may be configured to be received by the lid connection interface 144.

The lid connection interface 144 may extend about the entire periphery of the lid 140, as shown in the depicted embodiments. In some embodiments, the lid connection interface 144 may only extend about at least a majority of the periphery of the lid 140.

Figure 1F:
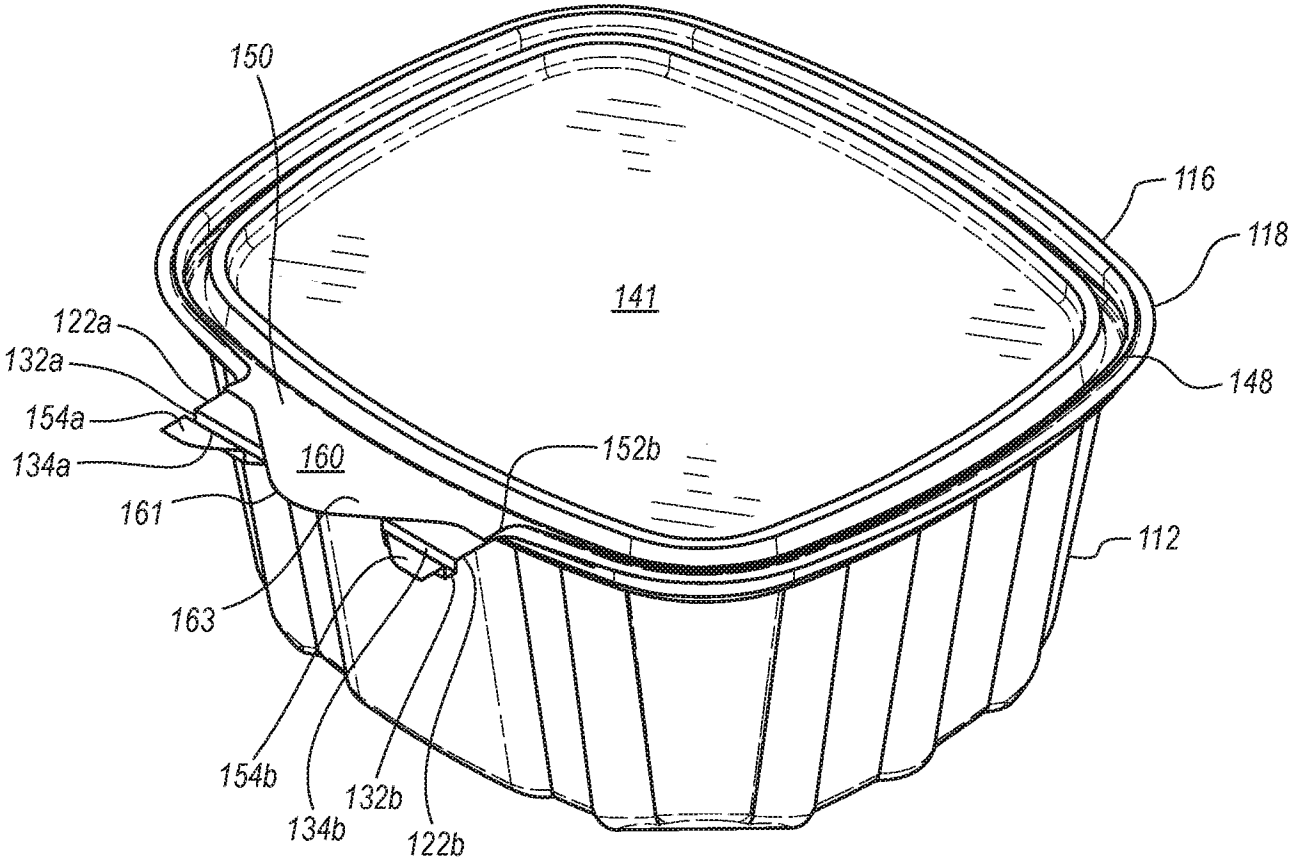
FIG. 1F is a perspective view of the tamper-evident container of FIG. 1 after it has been opened by detaching the lid from the base and then closing the container again by sealing the lid and base together.
Figure 1G:
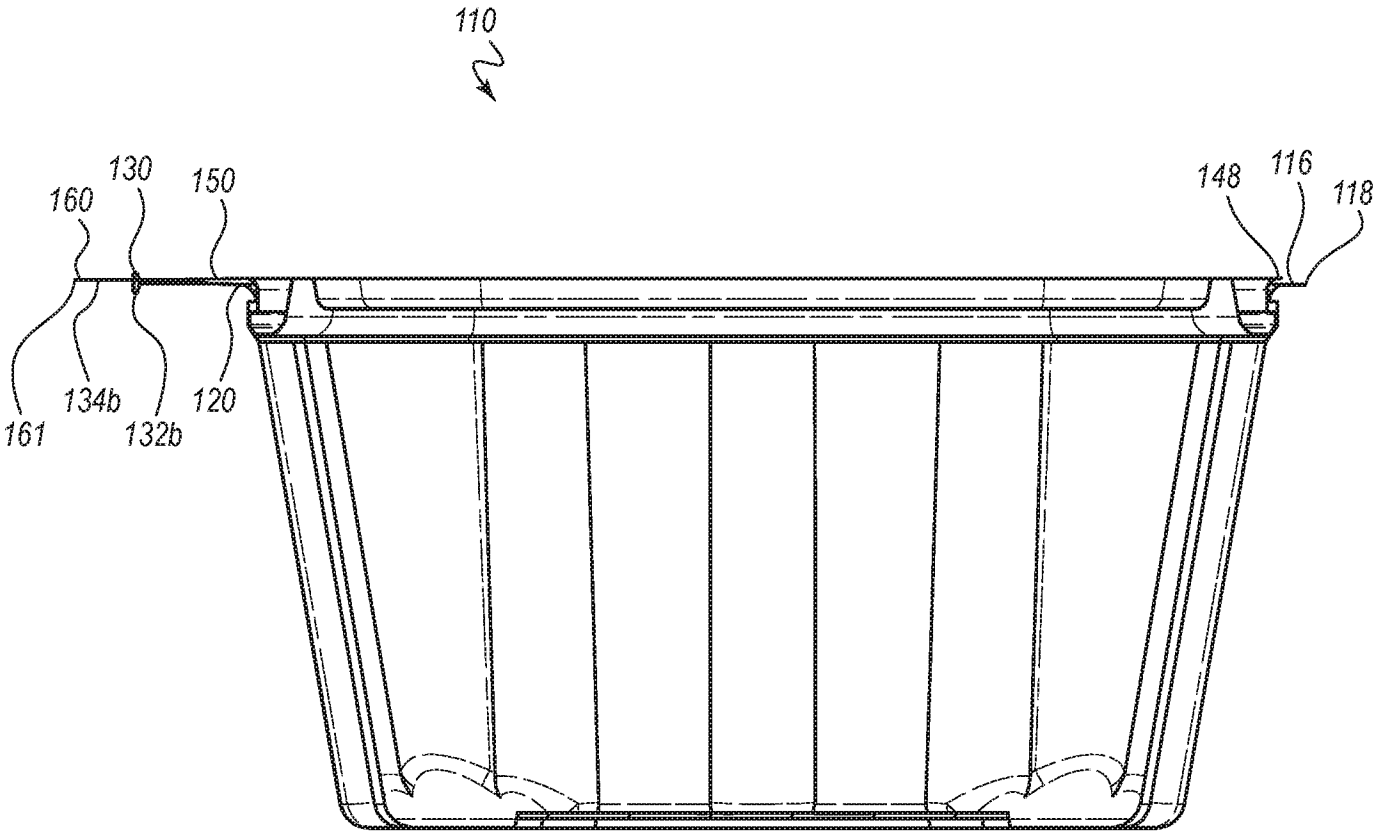
FIG. 1G is a side view of the tamper-evident container of FIG. 1 in a closed, pre-use configuration.

The relative dimensions of the base flange 116 and the lid flange 146 are such that the free edge 148 of the lid 140 and the free edge 118 of the base 110 can be touched by a user, but cannot be grasped to separate the lid 140 from the base 110. As shown in FIGS. 1C-1D and FIG. 1G, the free edge 118 of the base 110 extends radially outward further than the free edge 148 of the lid 140. This configuration combined with the close tolerance between the free edge 118 of the base 110 and the free edge 148 of the lid 140 makes it difficult for a user to separate the lid 140 from the base 110 without the use of tab 160.

With continued reference to FIG. 1A, and with additional reference to FIG. 1B, the base extension 120 extends from the base 110 and the lid extension 150 extends from the lid 140. The base extension has a first end 122*a* opposite from a second end 122*b*. The lid extension 150 has a first end 152*a* opposite from a second end 152*b*. The base extension 120 connects the base 110 to the hinge 130 and the lid extension 150 connects the lid 140 to the hinge 130 such that the base 110 is connected to the lid 140 via the hinge 130.

At least a portion of the base extension 120 and a portion of the lid extension 150 may be flat or planer. For example, in the illustrated embodiment, the base extension 120 and the lid extension 150 are in the same plane when the container is in the open configuration as depicted in FIG. 1A. In other embodiments, only a portion of the base extension 120 and the lid extension 150 may be substantially planar.

The hinge 130 has a first end 132*a* opposite from a second end 132*b*. The hinge 130 also has a first section 134*a* opposite from a second section 134*b*. The first section 134*a* terminates at the first end 132*a* and the second section 134*b* terminates at the second end 132*b*.

The tab 160 extends from the lid extension, in the embodiment depicted in FIGS. 1A-1G, in a direction away from the base 110 and the lid 140. The tab 160 extends beyond the hinge 130. The tab comprises a free edge 161 that defines an outermost perimeter of the tab 160 between a first end 162*a* and a second end 162*b* when the container 100 is in a closed, pre-use configuration with the lid coupled to the base as shown in FIGS. 1C-1D. The tab 160 has a surface 163 that is smooth. The tab 160 terminates at the first and second ends 162*a-b* of the free edge 161.

When the container 100 is in a closed, pre-use configuration with the lid coupled to the base, the tab 160 is between the first section 134*a* of the hinge 130 and the second section 134*b* of the hinge 130 and also between the first weakened region 164*a* and the second weakened region 164*b*, as shown in FIGS. 1C-1D. Additionally, when the container is in the closed, pre-use configuration, the first end 162*a* of the free edge 161 of the tab 160 transitions to the first weakened region 164*a* that is integral with the same extension from which the tab 160 extends, and the second end 162*b* of the free edge 161 of the tab 160 transitions to a second weakened region 164*b* that is integral with the same extension from which the tab 160 extends. In some embodiments, the tab may not be symmetrically centered between the two sections of the hinge and the weakened regions. Additionally, in some embodiments, there may only be a single section of the hinge and a single weakened region such that only a single section of a hinge may be grasped when the tab is grasped to tear along a single weakened region.

The weakened regions 164*a-b* may include any suitable form of weakening, such as a frangible line, a line of perforation, and/or a region of reduced thickness. In the illustrated embodiment, the weakened regions 164*a-b* comprise a line of perforation. The weakened regions 164*a-b* can permit controlled separation of the tab 160 from a neighboring portion of the lid extension 150.

When the container 100 is in the closed, pre-use configuration, the free edge 161 of the tab 160 traverses at least a portion of the hinge 130 and the hinge 130 is not coaxially aligned with the free edge 161 of the tab 160, the first weakened region 164*a*, or the second weakened region 164*b*. In the depicted embodiments, the free edge 161 of the tab traverses the hinge 130 at opposing ends 162*a-b*.

As indicated above, the container transitions from a closed, pre-use configuration to an open configuration by tearing along the weakened regions 164*a-b* such that the base 110 and the lid 140 are separated. The tearing of the weakened regions 164*a-b* occurs from first end 162*a* of the free edge 161 of the tab 160 to the first terminal end 166*a* of the weakened region 164*a* and from the second end 162*b* of the free edge 161 of the tab 160 to the second terminal end 166*b* of the weakened region 164*b*. At least a majority of the first weakened region 164*a* may be between the first section 134*a* of the hinge and the base 110 or and the lid 140. Similarly, at least a majority of the second weakened region 164*b* may be between the second section 134*b* of the hinge 130 and the base 110 or the lid 140. In the embodiments depicted in FIGS. 1A-1G, the weakened regions 164*a-b* are each respectively between the lid 140 and the hinge 130. More particularly, the weakened regions 164*a-b* are respectively between the lid 140 and first section 134*a* of the hinge 130 and the second section 134*b* of the hinge 130, when the container 100 is in the closed, pre-use configuration.

As best seen in FIG. 1B, a section of the free edge 161 of the tab 160 may be curved, a section of the first weakened region 164*a* may be curved, and a section of the second weakened region 164*b* may be curved. These sections are curved when the container is in the closed, pre-use configuration and after the container has been opened.

The first weakened region 164*a* and the second weakened region 164*b* have opposing sides that extend and terminate respectively at the first terminal end 166*a* and the second terminal end 166*b*. Each end 166*a-b* may have rounded corners at the opposing sides of the respective first weakened region 164*a* and the second weakened region 164*b*. The rounded corners enhance the safe handling of the container 100 after the base 110 and the lid 140 have been separated by tearing the first weakened region 164*a* and the second weakened region 164*b* to avoid the creation of sharp edges.

As shown in FIG. 1B, when the container is in the closed, pre-use configuration, a section of the free edge 161 of the tab 160 forms an angle $\theta_1$ with the first section 134*a* of the hinge 130 in a range from about 110° to about 170° and another section of the free edge of the tab forms an angle $\theta_2$ with the second section of the hinge in a range from about 110° to about 170°. Stated otherwise, when the container 100 is in the closed, pre-use configuration, the free edge 161 of the tab 160 may traverse at least a portion of the hinge 130, the first section 134*a* and the second section 134*b*, at opposing ends 162*a-b*, at angles $\theta_{1-2}$. Angles $\theta_{1-2}$ may be symmetrical as depicted in the illustrated embodiments. When the container is in the closed, pre-use configuration, a section of the first weakened region 164*a* forms an angle $\varnothing_1$ with the first section 134*a* of the hinge 130 in a range from about 20° to about 70° and a section of the second weakened region 164*b* forms an angle $\varnothing_2$ with the second section 134*b* of the hinge 130 in a range from about 20° to about 70°. The angles $\varnothing_{1-2}$ may be symmetrical as depicted in the illustrated embodiments. When the container is in the closed, pre-use configuration, a section of the first weakened region 164*a* and a section of the second weakened region 164*b* may be approximately parallel with the hinge 130.

As shown in FIG. 1D, lid extension 150 includes a first end 152*a* opposite from a second end 152*b*. As shown in FIG. 1B, lid extension 150 also includes a first portion 154*a* adjacent to the first weakened region 164*a* that remains connected to the first section 134*a* of the hinge 130 after the first weakened region 164*a* has been torn, as shown in FIG. 1E. Similarly, on the other side, lid extension 150 also includes a second portion 154*b* adjacent to the second weakened region 164*b* that remains connected to the second section 134*b* of the hinge 130 after the second weakened region 164*b* has been torn, as also shown in FIG. 1E.

Lid extension 150 also includes remainder portion 156, which includes a first region 157*a* and a second region 157*b*. When the container is in the closed, pre-use configuration, the first region 157*a* of the remainder portion 156 of the lid extension 150 is adjacent to the first weakened region 164*a* and the second region 157*b* of the remainder portion 156 of the lid extension 150 is adjacent to the second weakened region 164*b*. As indicated above, the tab 160 terminates at the first and second ends 162*a-b* of the free edge 161. Tab 160 is adjacent to the remainder portion 156 of the lid extension 150 such that the remainder portion 156 moves with the tab 160 to separate the lid connection interface 144 and the base connection interface 114 when the tab 160 and either the first portion 134*a* or the second portion 134*b* are pulled simultaneously in opposite directions. The remainder portion 156 remains integrally connected with the tab 160 after the lid and the base have been separated from each other.

The first portion 154*a* and the second portion 154*b* are each sized to be grasped between a thumb and finger of a user's first hand and the tab 160 is sized to be grasped between a thumb and finger of a user's second hand such that the container is opened by simultaneously pulling, in opposite directions, the tab and either the first portion or the second portion of the extension from which the tab extends. Pulling tab 160 upward, as shown in FIG. 1D, causes portions of the weakened regions 164*a-b* to tear. More particularly, the tearing of the weakened regions 164*a-b* starts at the first end 162*a* of the free edge 161 of the tab 160 and at the second end 162*b* of the free edge 161 of the tab 160 and then moves along each respective weakened region towards the terminal ends 166*a-b*. In some embodiments, the weakened regions 164*a-b* may be sufficiently weak that a user can grasp the tab 160 while also grasping the base 110 and just pull the tab to cause the necessary tearing. In other embodiments, it may be necessary to pull tab 160 and hold either first portion 154*a* or the second portion 154*b*. In additional embodiments, it may be necessary to pull tab 160 and to sequentially hold the first portion 154*a* to tear the first weakened region 164*a* and then hold the second portion 154*b* while pulling tab 160 to tear the second weakened region 164*b*.

As shown in FIG. 1E, after the container is opened by tearing along the weakened regions, the free edge 161 of tab 160 is adjacent to another free edge newly created by tearing the first weakened region 164*a* and the second weakened region 164*b*. The newly created free edge may include sections that are substantially parallel with the hinge 160.

Figure 3:
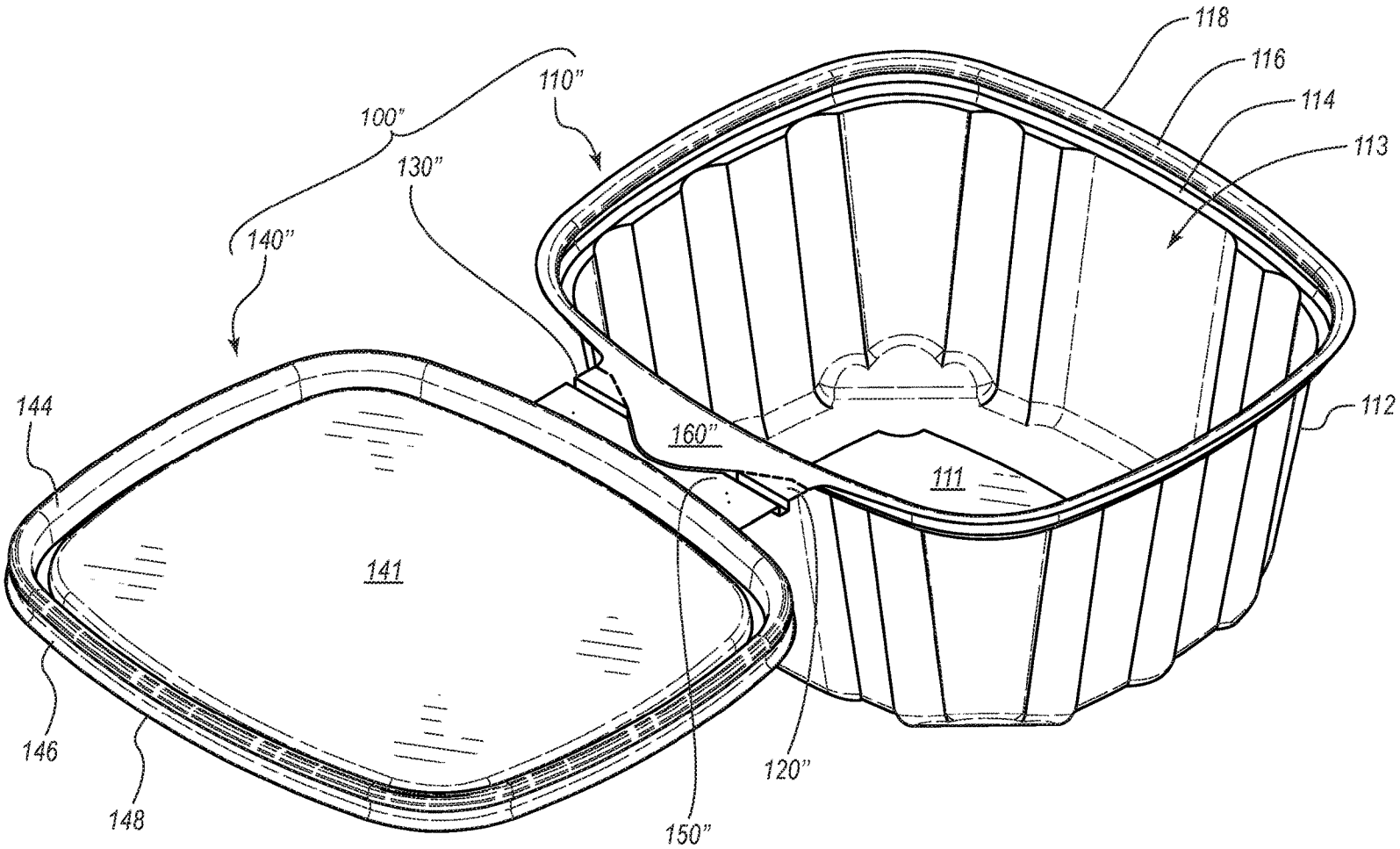
FIG. 3 is a perspective view of another embodiment of a tamper-evident container in an open configuration that differs from the embodiment shown in FIG. 1 based on the location of the tab.

Other embodiments of tamper-evident containers such as those depicted in FIGS. 2-3 at 100' and 100" may resemble the container 100 discussed above with respect to FIGS. 1A-1G. Additionally, container 200, container 200', and container 300, container 300', and container 300", which are respectively depicted in FIGS. 4A-4B, FIGS. 5A-5C, FIGS. 6A-6D, FIGS. 7A-7B, and FIGS. 8A-8B may resemble container 100 too. It will be appreciated that the illustrated embodiments may have analogous features. Accordingly, like features are designated with like reference numerals, with the leading digits incremented to "1," "2," or "3". Relevant disclosure set forth above regarding similarly identified features thus may not be repeated hereafter. Moreover, specific features of the container and related components shown in FIGS. 2A-8B may not be shown or identified by a reference numeral or specifically discussed in the written description that follows. However, such features may clearly be the same, or substantially the same, as features depicted in other embodiments and/or described with respect to such embodiments. Accordingly, the relevant descriptions of such features apply equally to the features of the container 100', container 100", container 200, container 200', container 300, container 300', and container 300". Any suitable combination of the features, and variations of the same, described with respect to the container 100 and components illustrated in FIG. 1A-1G, can be employed with the other containers and their components, and vice versa. This pattern of disclosure applies equally to further embodiments depicted in subsequent figures and described hereafter.

FIG. 2 depicts another embodiment of a tamper-evident container at 100' with a tab 160'. The tab 160' may be configured as shown to have a groove 163' that functions to provide grip assistance. Groove 163' may be replaced in another embodiment with raised lettering that also functions to provide grip assistance. For example, the word "PULL" could be legible when the container is in the closed configuration so that a user can easily appreciate the mechanism for opening the container and simultaneously benefit from the grip assistance provided by the raised letters. Other forms of texturing may also be used.

FIG. 3 depicts an additional embodiment of container featuring a reversal of the arrangement of the tab. In particular, FIG. 3 depicts the tab 160" extending from the base extension 120" instead of the lid extension 150" in a direction away from the lid 140" and the base 110" when the container is in a closed, pre-use configuration with the lid coupled to the base. In this embodiment, a user pulls tab 160" downward instead of upward as in the embodiments depicted in FIGS. 1A-1G. Like the container 100, when the container 100" is in a closed, pre-use configuration, the container is opened by tearing along the weakened regions to the first and second ends of the same extension from which the tab extends such that the lid and the base are separated.

Figure 5A:
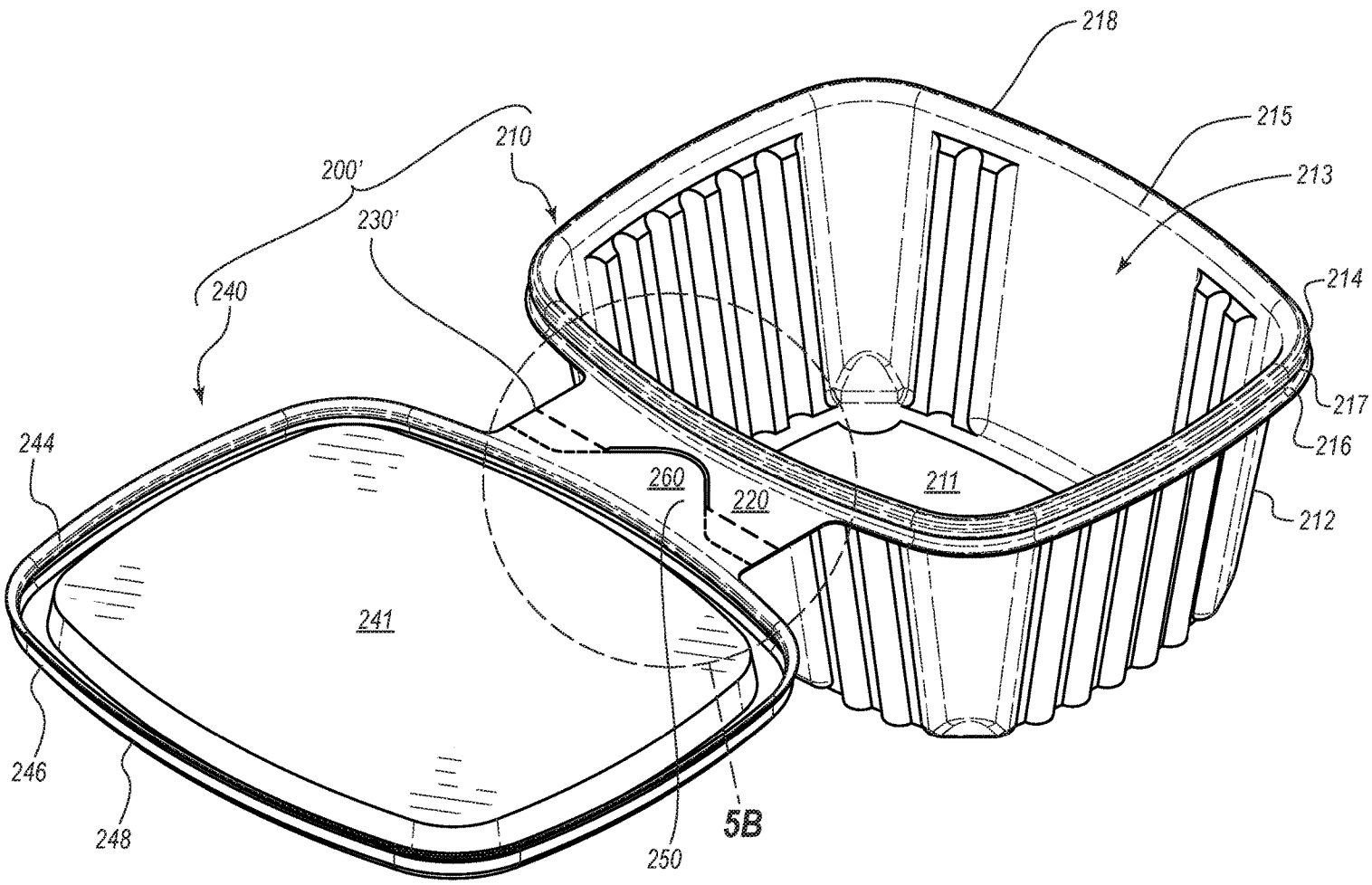
FIG. 5A is a perspective view of another embodiment of a tamper-evident container in an open configuration with a single, weakened fold line.
Figure 5B:
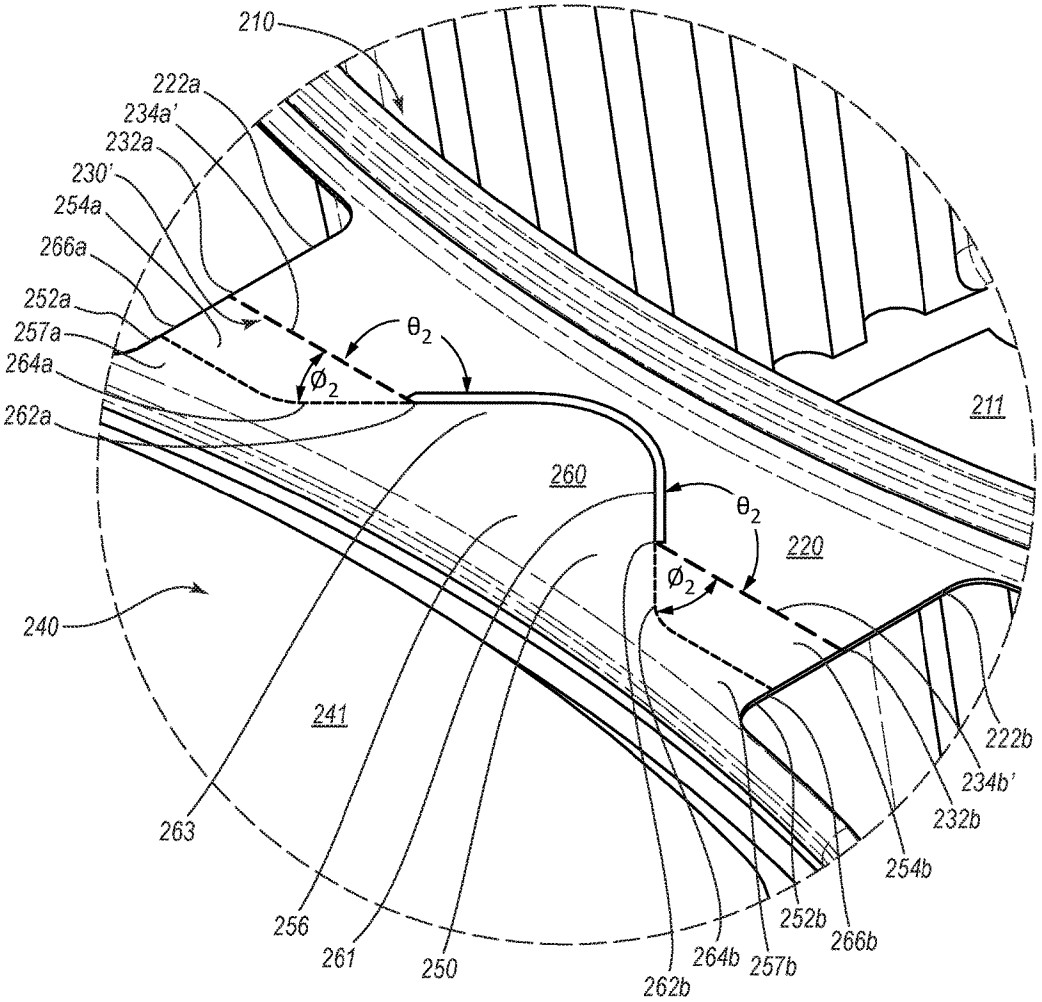
FIG. 5B is an enlarged perspective view of the section encircled at 13 of the tamper-evident container of FIG. 5A.
Figure 5C:
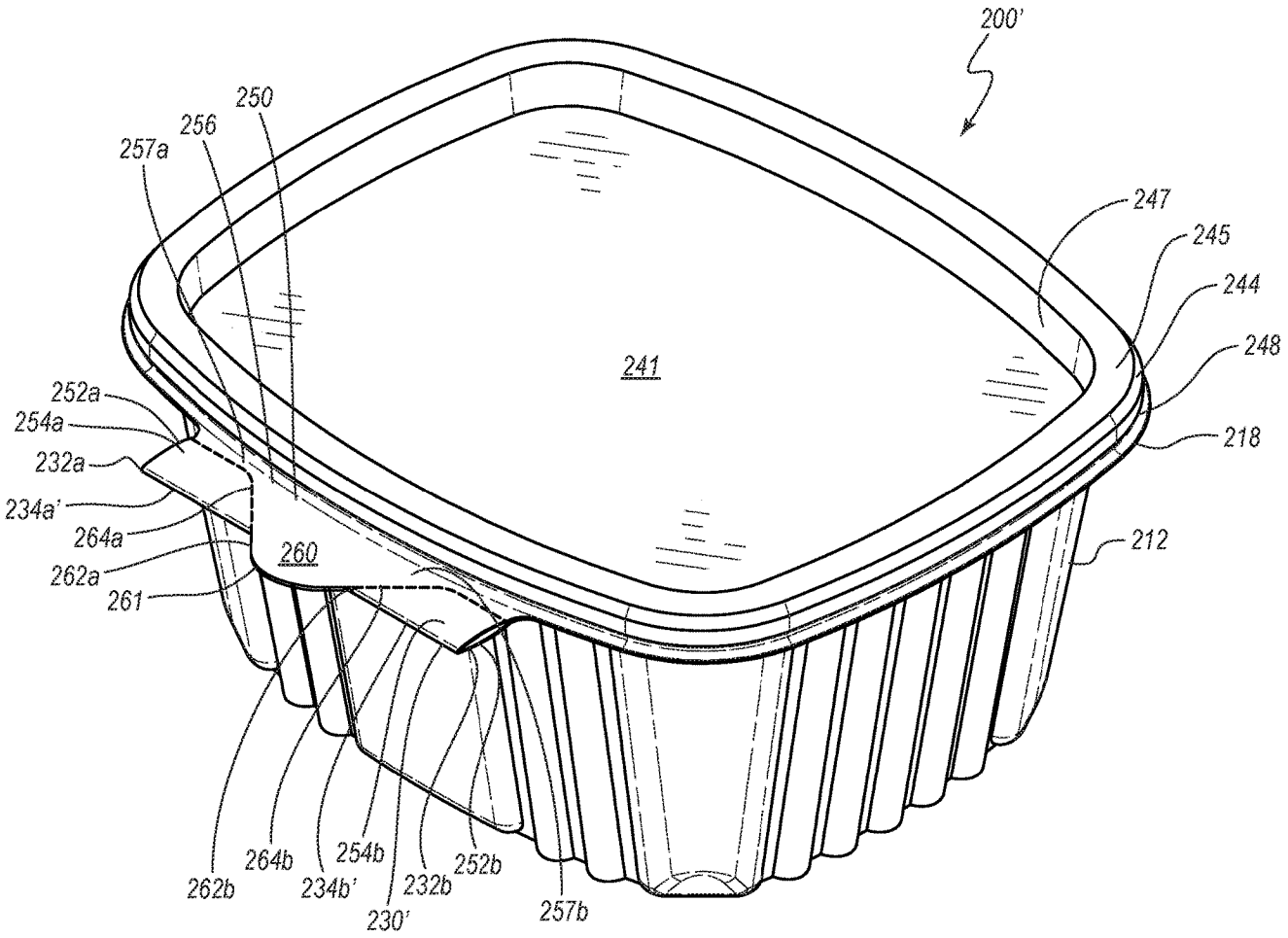
FIG. 5C is a perspective view of the tamper-evident container of FIG. 5A in a closed, pre-use configuration.

Container 200, container 200', container 300, container 300', and container 300" differ from container 100 primarily with respect to their hinges and the configuration of the seal between the lids and the bases. Container 100 has a hinge 130, as best seen in FIG. 1B, with two fold lines. Container 200 has a hinge 230 with a single fold line as shown in FIGS. 4A-4B. A hinge comprising a single fold line may also be weakened as shown in FIGS. 5A-5C. The hinge may also be "coined" to deform the sheet used to form the container such that the hinge is an area with a thinner cross-section than adjacent portions as best seen in FIG. 6D. As mentioned, the configuration of the rims of the lids and the bases differs for the embodiments shown in FIGS. 4A-8B relative to those shown in FIGS. 1A-3. These configurations are described in detail below but in short, the configuration of the rims shown for the embodiments in FIGS. 1A-3 are essentially reversed for those shown in FIGS. 4A-8B.

Container 200 is shown in FIG. 4A in an open configuration like the view of container 100 in FIG. 1. Container 200 is shown in FIG. 4B in a closed, pre-use configuration like the view of container 100 in FIG. 1C. The single fold line of hinge 230 does not permit the open configuration shown in FIG. 4A to be achieved as easily as the two fold lines of hinge 130. In addition to opening more easily, the two fold lines of hinge 130 also enable container 100 to more easily remain open.

Container 200' differs from container 200 only with respect to its hinge 230'. Both hinge 230 and hinge 230' have a single fold line but the fold line of hinge 230' is weakened so that it folds open more easily than hinge 230 and remains open more readily than hinge 230. The weakened fold line may include any suitable form of weakening, such as a frangible line, a line of perforation, and/or a region of reduced thickness. In the illustrated embodiment, the weakened fold line of hinge 230' comprises perforations. The weakened fold line of hinge 230' is not configured to be a tear line because opening a container with the configuration of the embodiments disclosed herein requires a user to pinch half of a fold line and the adjacent portions of the base extension and the lid extension while pulling on the tab, which prevents tearing along the hinge. In other words, the ability to tear along the hinge is not relevant because the tearing occurs along the weakened regions such as weakened regions 264*a-b*. Because hinge 230' does not need to be torn, it may be designed to differ in resistance to tearing relative to weakened regions 264*a-b*. For example, hinge 230' may not be tearable like weakened regions 264*a-b* or it may require significantly more force to tear hinge 230' than is required to tear along weakened regions 264*a-b*.

Figure 6A:
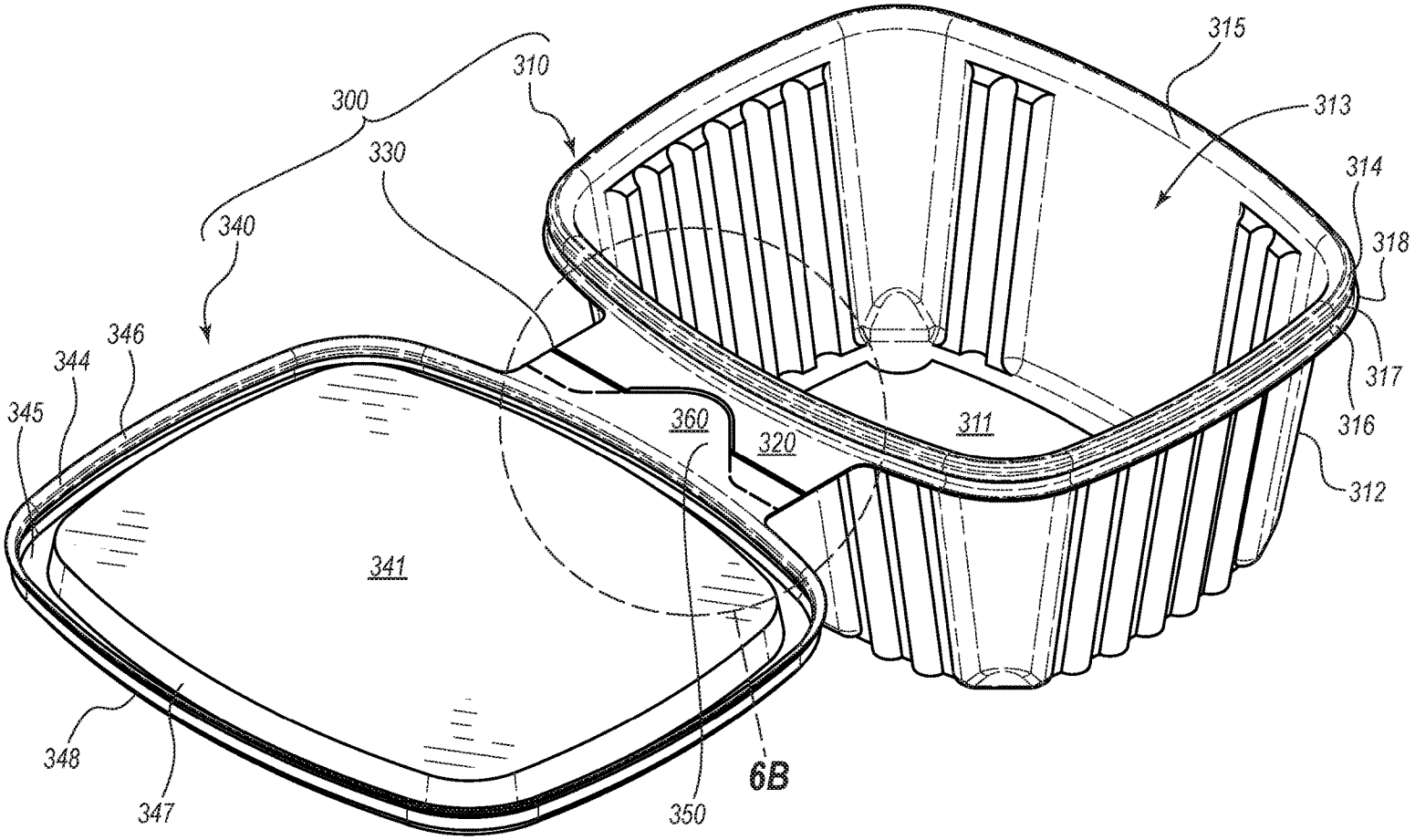
FIG. 6A is a perspective view of another embodiment of a tamper-evident container in an open configuration with a hinge having a smaller cross-sectional thickness than portions adjacent to the hinge.
Figure 6B:
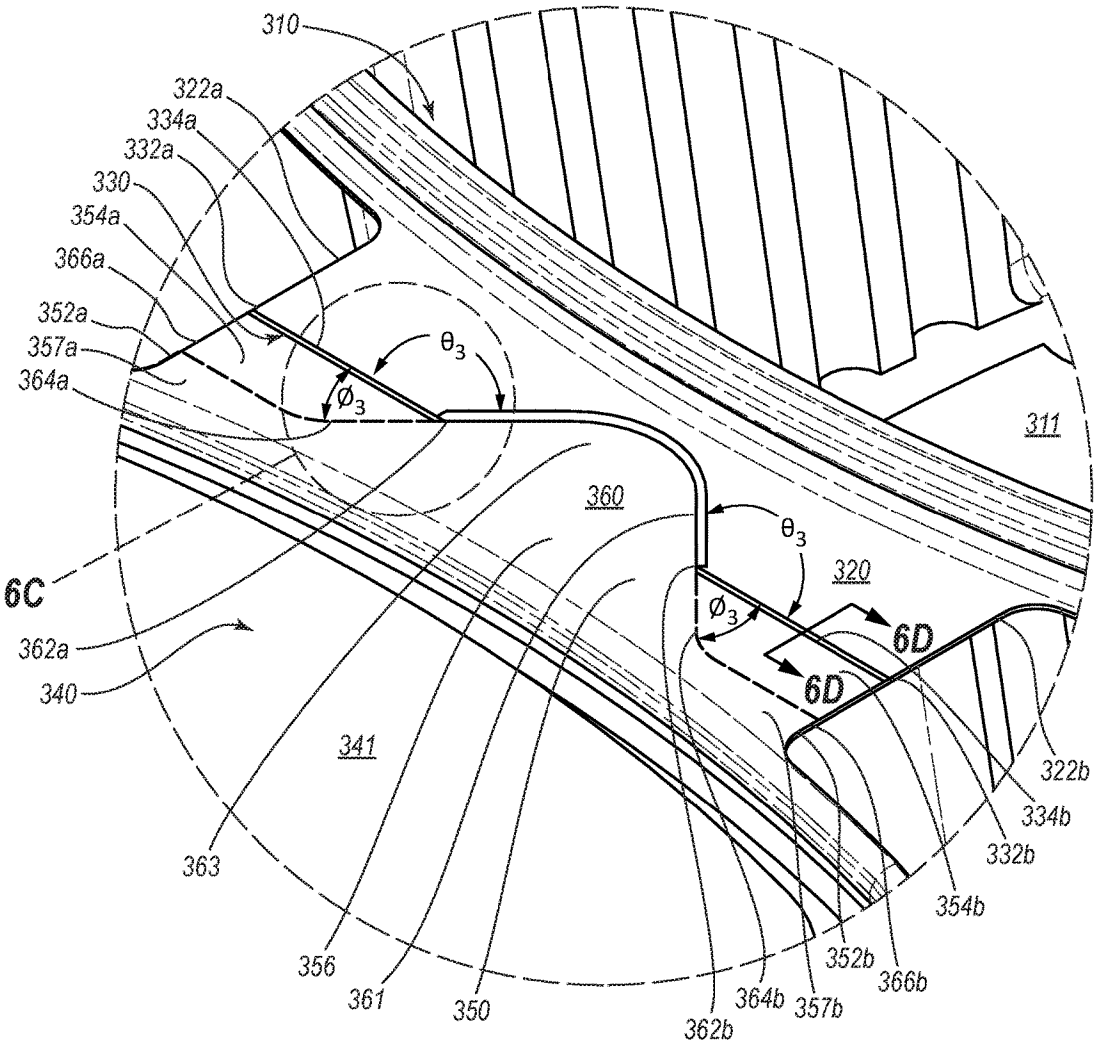
FIG. 6B is an enlarged perspective view of the section encircled at 6B of the tamper-evident container of FIG. 6A.

Container 300 is shown in FIG. 6A in an open configuration. FIG. 6B is an enlarged perspective view of the section encircled at 6B of the tamper-evident container of FIG. 6A. Like FIG. 5B, FIG. 6B shows essentially the same features that are shown in FIG. 1B other than the particular hinge while also showing some different relative dimensions and designs for some of the components. Weakened regions 164*a-b*, 264*a-b*, 364*a-b*, 364*a'-b'*, and 364*a"-b"* may have different curves or different lengths, which impact the contours of lid extensions 150, 250, 350, 350', and 350"; the base extensions 120, 220, 320, 320', and 320"; and the tabs 160, 260, 360, 360', and 360". For example, tabs 260 and 360 may extend further and be narrower than tab 160, as depicted.

Figure 6C:
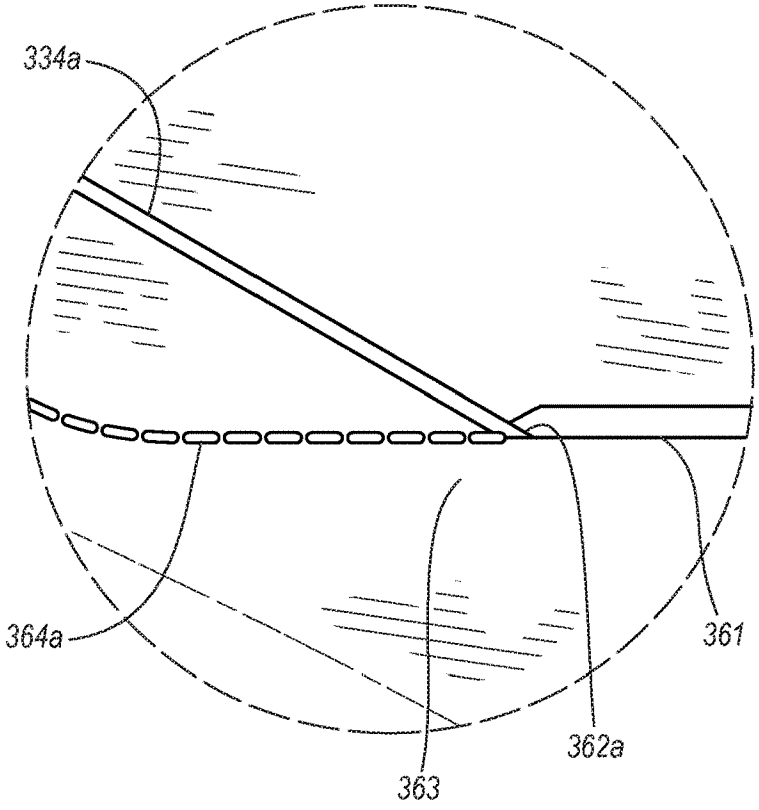
FIG. 6C is an enlarged perspective view of the section encircled at 6C of the tamper-evident container of FIG. 6B.
Figure 6D:
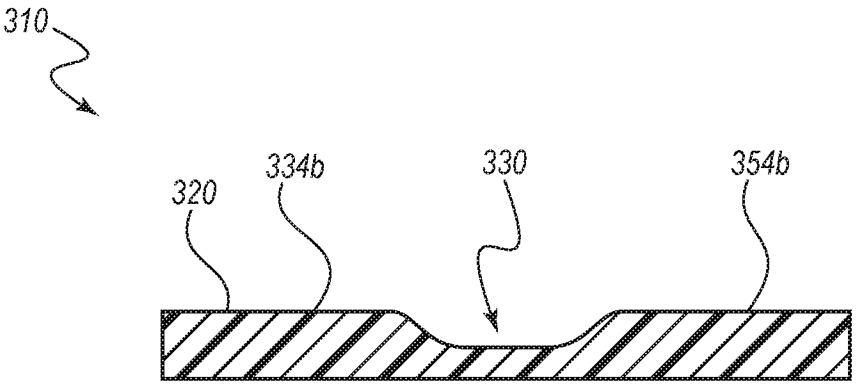
FIG. 6D is a cross-sectional view of the hinge in the tamper-evident container of FIG. 6B taken along cutting line 6D-6D of FIG. 6B.
Figure 6E:
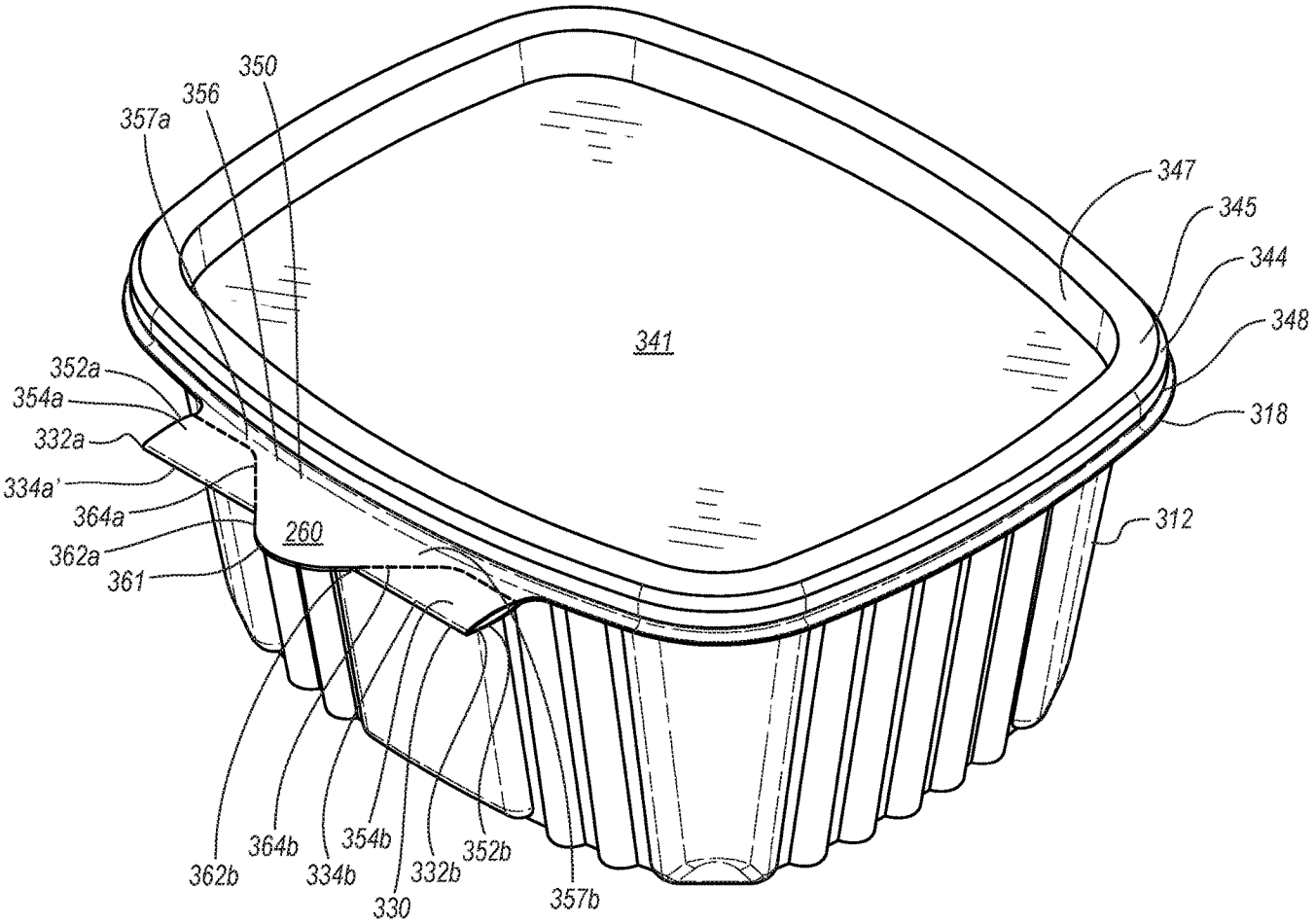
FIG. 6E is a perspective view of the tamper-evident container of FIG. 6A in a closed, pre-use configuration.

FIG. 6C is an enlarged perspective view of the section encircled at 6C of the tamper-evident container of FIG. 6B. FIG. 6C shows that when the container 300 is in the closed, pre-use configuration, the first section 334*a* of the hinge 330 is intersected by the first weakened region 364*a* and the free edge 361 of the tab 360 at the first end 362*a* of the free edge 361 of the tab 360. Similarly, FIG. 6C shows that when the container 300 is in the closed, pre-use configuration, the second section 334*b* of the hinge 330 is intersected by the second weakened region 364*b* and the free edge 361 of the tab 360 at the second end 362*b* of the free edge 361 of the tab 360.

Container 300 features a hinge 330 that is also a weakened, single fold line. More specifically, hinge 330 is a region of reduced thickness as best appreciated with reference to FIG. 6D. Hinge 330 may be formed by any suitable method. For example, hinge 330 may be formed by a molding technique referred to as "coining" which involves thinning by deformation of the sheet used to form the container.

The disclosed configurations are easily opened. For example, when container 300 is in the closed, pre-use configuration shown in FIG. 6E, one can grasp first portion 354*a* of lid extension 350, the adjacent half of hinge 330, and base extension 320 between one's thumb and index finger while simultaneously grasping the tab 360 between one's thumb and index finger with the other hand and pulling in opposite directions. It is advantageous to have a single tab between two weakened portions so that a user can open the container just as easily whether left handed or right handed. The first and second portions of the extension that remain connected to the hinge are advantageously sized to be grasped with about half of one's thumb. Additionally, the first and second weakened regions may extend further from the hinge so that it is easier to grasp half of the hinge and to tear along the weakened regions.

The configuration of the components of the lids and the bases in containers 200 and 300 that form a seal are identical. These components of containers 200 and 300 are essentially the reverse of the components of the lid and base of container 100 that enable base 110 and lid 140 to be sealed together. The base 310 has a sidewall 312 with a base connection interface 314 that extends from an inner perimeter 315 at the mouth of base 310. The base 310 has a flange 316 extending from a recessed track 317. The recessed track 317 is part of the base connection interface 314. The flange 316 terminates at a free edge 318. The base connection interface 314, flange 316, recessed track 317, and the free edge 318 extend circumferentially entirely around base 310.

Lid 340 has a top end 341 that extends to a channel defined by a lid connection interface 344, a connecting wall 345, and a channel inner wall 347. Lid connection interface 344 extends to a lid flange 346 that terminates at a free edge 348. When container 300 is closed with the lid 340 and the base 310 sealed together, base connection interface 314 extends into the channel of lid 340 and against lid connection interface 344. Lid connection interface 344 and base connection interface 314 have a complementary or otherwise cooperative portion of the base 110. For example, the lid connection interface 344 may be configured to selectively couple with the base connection interface 314. More particularly, lid connection interface 344 has a portion that extends radially inward and fits in the recessed track 317 of base connection interface 314.

After the container 300 has been transitioned to the open post-use configuration, it may be closed again, and thereby transitioned to a closed post-use configuration. For example, the connection interfaces 314, 344 and the base 310 and the lid 340, respectively, can be configured to repeatedly engage with each other and disengage from each other.

Lid flange 346 extends slightly further outward than base flange 316 such that free edge 348 extends slightly beyond free edge 318. The configuration and relative dimensions of the base flange 316 and the lid flange 346 are such that the free edge 348 of the lid 340 and the free edge 318 of the base 310 can be touched by a user, but cannot be grasped to separate the lid 340 from the base 310. This configuration combined with the close tolerance between the free edge 318 of the base 310 and the free edge 348 of the lid 340 makes it difficult for a user to separate the lid 340 from the base 310 without the use of tab 360.

Figure 7C:
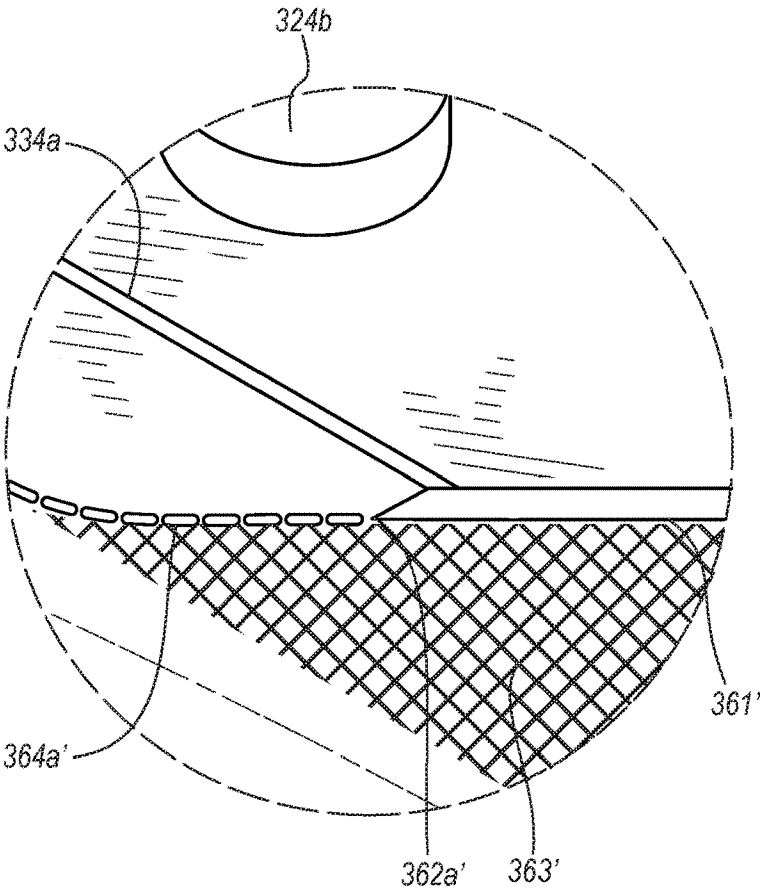
FIG. 7C is an enlarged perspective view of the section encircled at 7C of the tamper-evident container of FIG. 7B.
Figure 7A:
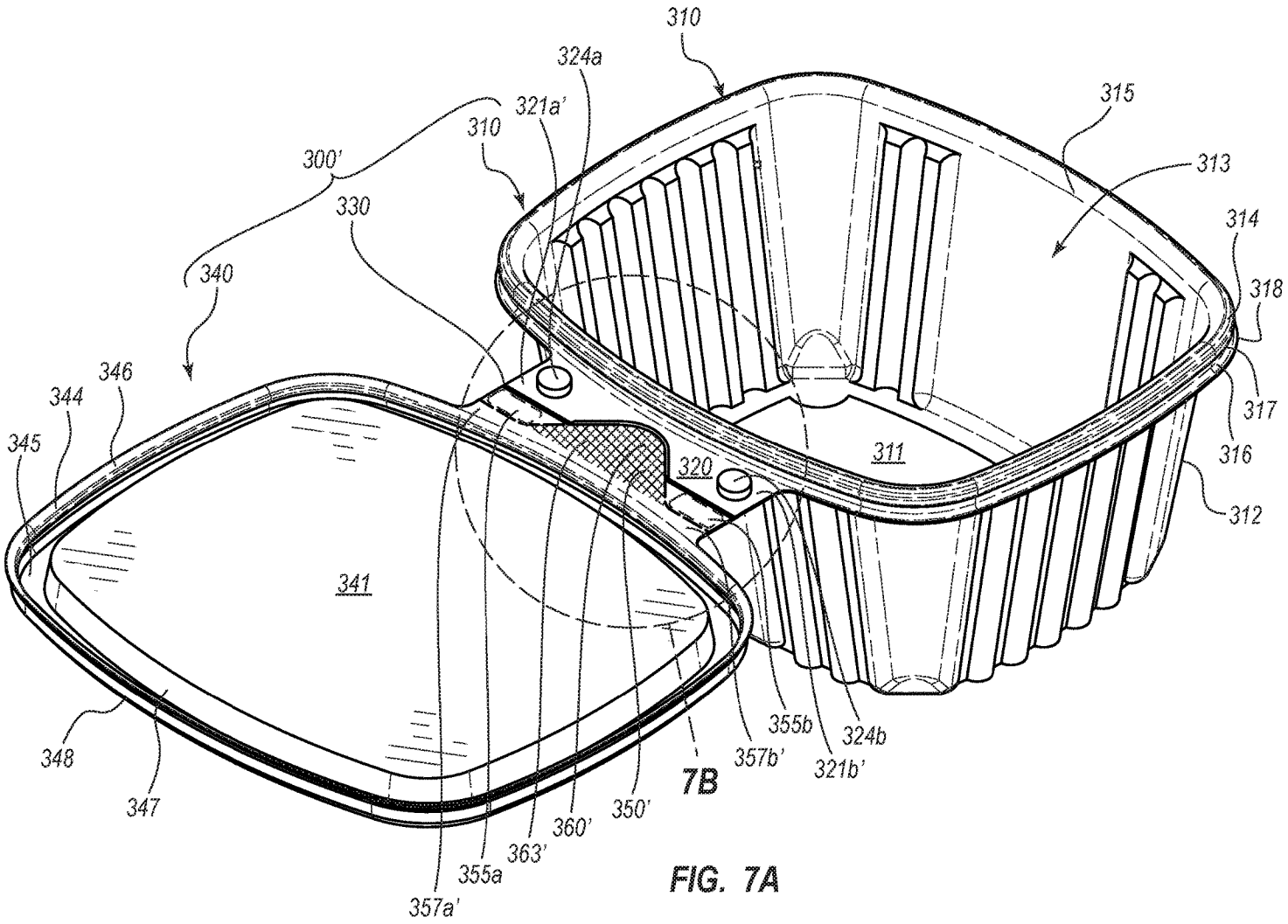
FIG. 7A is a perspective view of another embodiment of a tamper-evident container in an open configuration with and a textured service and bumps to help indicate whether the container has been opened.
Figure 7B:
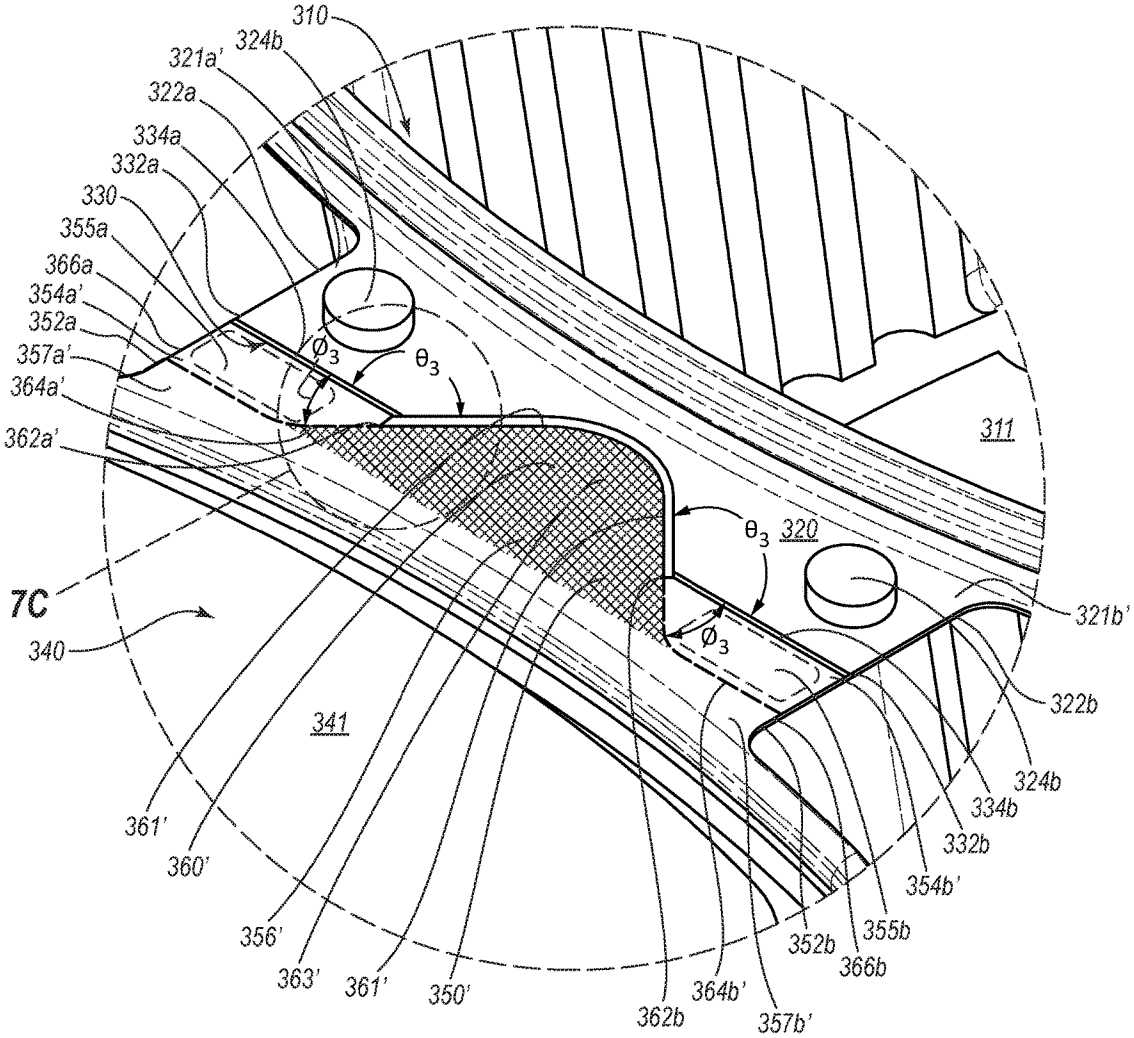
FIG. 7B is an enlarged perspective view of the section encircled at 7B of the tamper-evident container of FIG. 7A.

FIGS. 7A-7B depict container 300' having a tab 360' extending from a lid extension 350'. Tab 360' has a textured surface 363'. The portion of the lid extension 350' adjacent to the tab 360' also has a textured surface.

Lid extension 350 includes a first portion 354*a'* adjacent to the first weakened region 364*a'* and a second portion 354*b'* adjacent to the second weakened region 364*b'*. First portion 354*a'* has a section 355*a* featuring raised lettering such as "HOLD" and second portion 354*b'* also has a section 355*b* featuring the same raised lettering. In addition to the instructions for the consumer, the raised lettering also functions to provide grip assistance. A similar section may also be featured in textured surface 363' with raised lettering such as "PULL" so that a consumer readily appreciates that tab 360 should be pulled while either first portion 354*a'* or second portion 354*b'* should be held.

FIGS. 7A-7B depict base extension 320' with a first region 321*a'* that terminates at a first end 322*a* and a second region 321*b'* that terminates at a second end 322*b*. First portion 321*a'* has a first bump 324*a*. Similarly, second region 321*b'* may also have a bump such as second bump 324*b*. When the container 300' is in the closed, pre-use configuration, the bumps 324*a-b* are each respectively oriented toward first region 357*a'* and second region 357*b'* of remainder portion 356'. Stated otherwise, each bump extends toward a portion of the same extension from which the tab extends when the container is in the closed, pre-use configuration and after the tamper-evident container 300' has been opened by detaching the lid 340 from the base 310 and then closing the container 300' again by sealing the lid 340 and base 310 together. When the container 300' is resealed, the bumps 324*a-b* press against the first region 357*a*' and the second region 357*b*', this configuration makes it easier to see that the container has been opened because the bumps 324*a-b* prevent the first region 357*a*' and the second region 357*b*' of remainder portion 356' from respectively falling flat on the first region 321*a*' and the second region 321*b*'.

In some embodiments, there may be a bump on only one of the regions of the base extension or the lid extension. As discussed above, in some embodiments, there may only be a single section of the hinge and a single weakened region such that only a single section of a hinge may be grasped when the tab is grasped to tear along a single weakened region. In such embodiments, a bump may extend from a section of either the sole region of the base extension or the sole region of the lid extension.

FIG. 7C is an enlarged perspective view of the section encircled at 7C of the tamper-evident container of FIG. 7B. FIG. 7C shows that when the container 300' is in the closed, pre-use configuration, the first section 334*a* of the hinge 330 is traversed by the free edge 361' of the tab 360' and the second section 334*b* of the hinge 330 is traversed by the free edge 361' of the tab 360'. Stated otherwise, first end 362*a*' of free edge 361' terminates beyond first section 334*a* of the hinge 330 and the second end 362*b*' of free edge 361' terminates beyond second section 334*b* of the hinge 330. Free edge 361' intersects the first weakened region 364*a*' at the first end 362*a*' and the free edge 361' intersects the second weakened region 364*b*' at second end 362*b*' such that pulling tab 360' tears the first weakened region 364*a*' and the second weakened region 364*b*'. As indicated above, the tab terminates at the first and second ends of the free edge. When the first and second ends extend beyond the weakened regions, it is easier to tear the weakened regions than when the first and second ends are at the intersection of weakened regions and the sections of the hinge. The terms "intersect" and "intersection" should be interpreted with their ordinary meaning to indicate that the free edge of the tab, particularly the ends of the free edge of the tab are at the weakened regions or a section of the hinge or are sufficiently close to the weakened regions that tearing of the material between an end of the free edge of the tab and a first perforation in the weakened region occurs when the tab is pulled. "Intersect" and "intersection" are distinguished from "traversing," which means that the free edge of the tab extends across a section of the hinge.

Figure 8A:
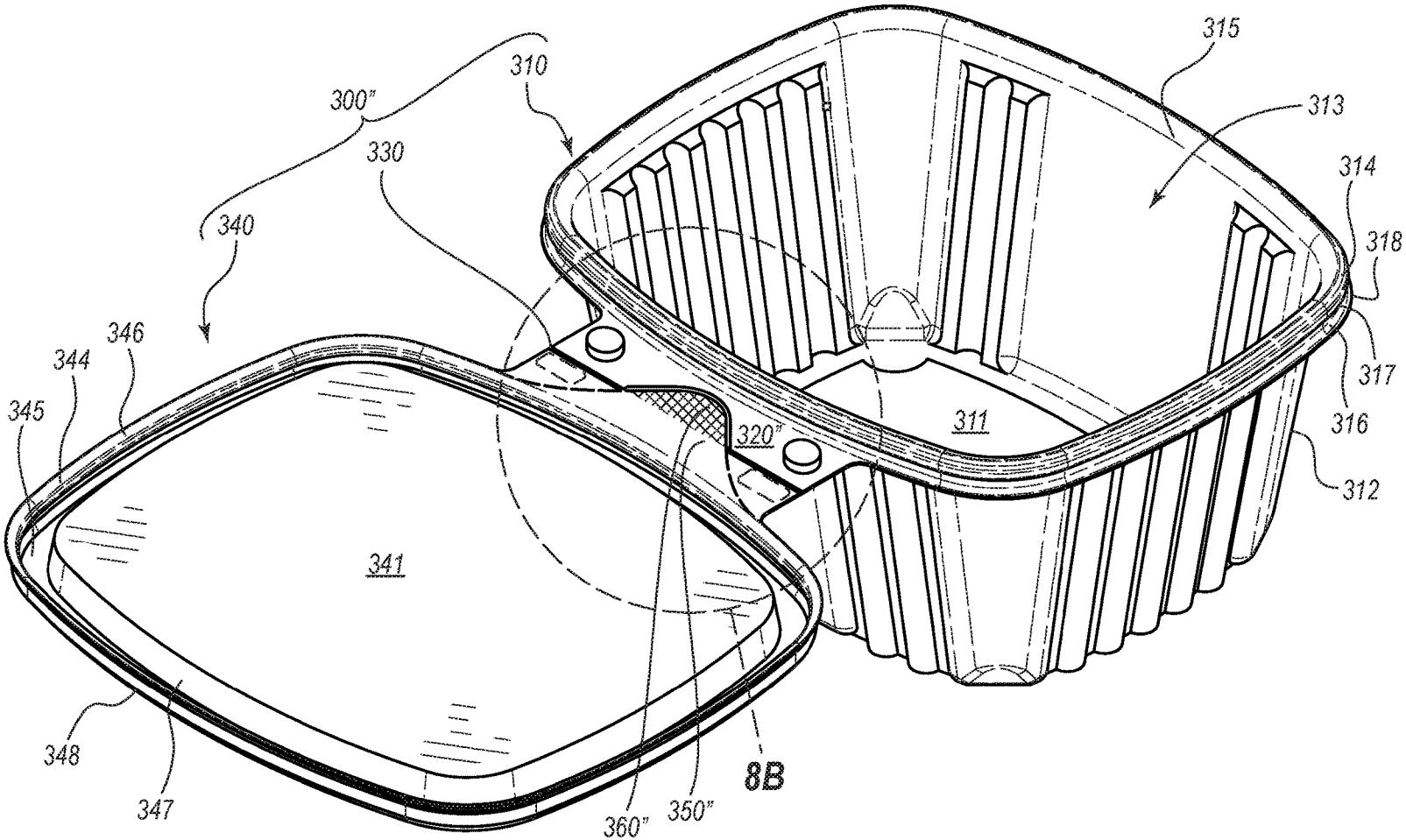
FIG. 8A is a perspective view of another embodiment of a tamper-evident container in an open configuration with a tab having a textured service and bumps to help indicate whether the container has been opened.
Figure 8B:
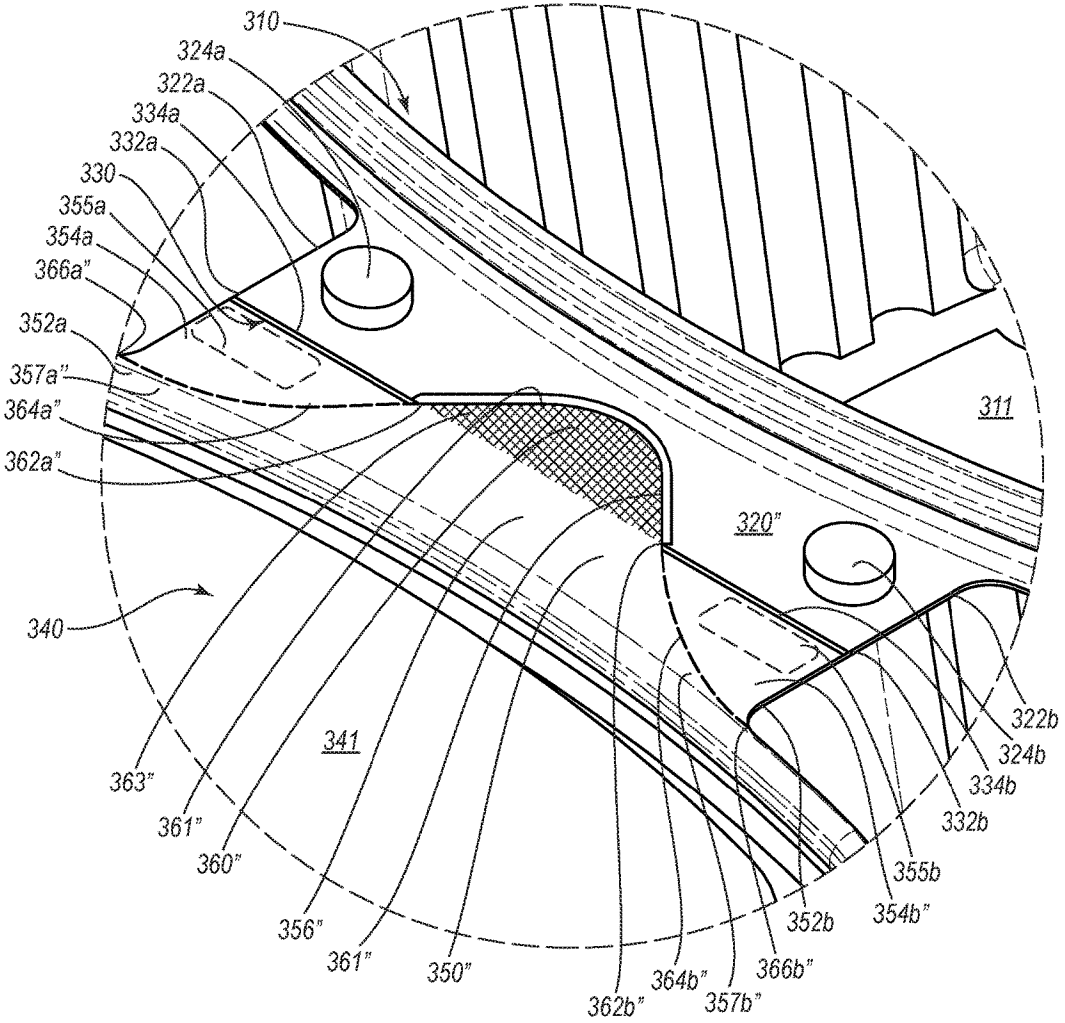
FIG. 8B is an enlarged perspective view of the section encircled at 7B of the tamper-evident container of FIG. 7A.

FIGS. 8A-8B depict a container 300" with a first weakened region 364*a*" that extends with a curved configuration from a first end 362*a*" of the free edge 361' to the first terminal end 366*a* of the weakened region 364*a* and a second weakened region 364*b*" that extends with a curved configuration from the second end 362*b*" of the free edge 361 of the tab 360" to the second terminal end 366*b*" of the weakened region 364*b*". The first weakened region 364*a*" and second weakened region 364*b*" may in another embodiment extend with a straight or relatively straight configuration instead of the curved configuration depicted in FIGS. 8A-8B. First terminal end 366*a*" and second terminal end 366*b*" are positioned closer to lid 340 than first terminal end 366*a*' and second terminal end 366*b*' in FIGS. 7A-7B.

FIGS. 8A-8B depict a container 300" with a tab 360" that is shaped like tab 360' and also has a textured surface 363." However, the textured surface does not extend to the remainder portion 356" of lid extension 350" like in FIGS. 7A-7C.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

References to approximations are made throughout this specification, such as by use of the terms "about" or "approximately." For each such reference, it is to be understood that, in some embodiments, the value, feature, or characteristic may be specified without approximation. For example, where qualifiers such as "about," "substantially," and "generally" are used, these terms include within their scope the qualified words in the absence of their qualifiers. For example, where the term "substantially planar" is recited with respect to a feature, it is understood that in further embodiments, the feature can have a precisely planar configuration.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the preceding claims up to and including claim [x]," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments; claim 5 can depend from any one of claim 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed in accordance with 35 U.S.C. § 112 ¶6. Embodiments of the invention in which an exclusive property or privilege is claimed are defined as follows.

The invention claimed is:

1. A tamper-evident container comprising:

a base comprising a base extension, the base extension having a first end opposite from a second end;

a lid comprising a lid extension, the lid extension having a first end opposite from a second end;

a hinge, wherein the base extension connects the base to the hinge, wherein the lid extension connects the lid to the hinge, and wherein the hinge has at least a first section; and a tab extending from either the lid extension or the base extension;

wherein, when the container is in a closed, pre-use configuration with the lid coupled to the base, the tab comprises a free edge that defines an outermost perimeter of the tab between a first end and a second end;

wherein, when the container is in the closed, pre-use configuration, the tab extends in a direction away from the lid and the base such that the tab extends beyond the hinge;

wherein, when the container is in the closed, pre-use configuration, the first end of the free edge of the tab transitions to a first weakened region that is integral with the same extension from which the tab extends;

wherein the hinge is not coaxially aligned with the free edge of the tab or the first weakened region;

wherein, when the container is in the closed, pre-use configuration, the first weakened region extends from the first end of the free edge of the tab to a first terminal end at the first end of the extension from which the tab extends; and wherein, when the container is in the closed, pre-use configuration, the same extension from which the tab extends comprises at least a first portion and the other extension comprises at least a first opposing portion with a first bump that extends toward the first portion of the same extension from which the tab extends.

2. The container of claim 1, wherein, when the container is in the closed, pre-use configuration, the first portion of the same extension from which the tab extends is adjacent to the first weakened region and remains connected to the first section of the hinge after the first weakened region has been torn;

wherein, when the container is in the closed, pre-use configuration, a remainder portion of the extension from which the tab extends is adjacent to the first weakened region; and wherein the remainder portion remains integrally connected with the tab and moves with the tab to separate the lid connection interface and the base connection interface when the container is opened.

3. The container of claim 1, wherein the hinge has a second section;

wherein, when the container is in the closed, pre-use configuration, the tab extends between the first section of the hinge and the second section of the hinge;

wherein, when the container is in the closed, pre-use configuration, the second end of the free edge of the tab transitions to a second weakened region that is integral with the same extension from which the tab extends;

wherein the hinge is not coaxially aligned with the second weakened region;

wherein, when the container is in the closed, pre-use configuration, the second weakened region extends from the second end of the free edge of the tab to a second terminal end at the second end of the extension from which the tab extends.

4. The container of claim 3, wherein, when the container is in the closed, pre-use configuration, the same extension from which the tab extends comprises a second portion and the other extension comprises a second opposing portion with a second bump that extends toward the second portion of the same extension from which the tab extends.

5. The container of claim 1, wherein, when the container is in the closed, pre-use configuration, the container is opened by tearing along the weakened regions to the first and second ends of the same extension from which the tab extends such that the lid and the base are separated.

6. The container of claim 1, wherein, when the container is resealed with the lid recoupled to the base, the first bump presses against the first portion of the same extension from which the tab extends.

7. A tamper-evident container comprising:

a base comprising a base extension, the base extension having a first end opposite from a second end;

a lid comprising a lid extension, the lid extension having a first end opposite from a second end;

a hinge, wherein the base extension connects the base to the hinge, wherein the lid extension connects the lid to the hinge, and wherein the hinge has a first section opposite from a second section; and a tab extending from either the lid extension or the base extension;

wherein, when the container is in a closed, pre-use configuration with the lid coupled to the base, the tab comprises a free edge that defines an outermost perimeter of the tab between a first end and a second end;

wherein, when the container is in the closed, pre-use configuration, the tab extends in a direction away from the lid and the base such that the tab extends beyond the hinge;

wherein, when the container is in the closed, pre-use configuration, the first end of the free edge of the tab transitions to a first weakened region that is integral with the same extension from which the tab extends, and the second end of the free edge of the tab transitions to a second weakened region that is integral with the same extension from which the tab extends;

wherein the hinge is not coaxially aligned with the free edge of the tab, the first weakened region, or the second weakened region;

wherein, when the container is in the closed, pre-use configuration, the same extension from which the tab extends comprises a first portion and a second portion, the other extension comprises a first opposing portion and a second opposing portion, the first opposing portion has a first bump that extends toward the first portion of the same extension from which the tab extends, and the second opposing portion has a second bump that extends toward the second portion of the same extension from which the tab extends; and wherein, when the container is in the closed, pre-use configuration, the container is opened by tearing along the weakened regions to the first and second ends of the same extension from which the tab extends such that the lid and the base are separated.

8. The container of claim 7, wherein, when the container is in the closed, pre-use configuration, the first section of the hinge is intersected by the first weakened region and the free edge of the tab at the first end of the free edge of the tab, and the second section of the hinge is intersected by the second weakened region and the free edge of the tab at the second end of the free edge of the tab.

9. The container of claim 7, wherein, when the container is in the closed, pre-use configuration, the first section of the hinge is traversed by the free edge of the tab and the second section of the hinge is traversed by the free edge of the tab.

10. The container of claim 7, wherein, when the container is in the closed, pre-use configuration with the lid coupled to the base, the tab is between the first section of the hinge and the second section of the hinge.

11. The container of claim 10, wherein, when the container is in the closed, pre-use configuration, a section of the free edge of the tab forms an angle with the first section of the hinge in a range from about 110° to about 170° and another section of the free edge of the tab forms an angle with the second section of the hinge in a range from about 110° to about 170°.

12. The container of claim 10, wherein, when the container is in the closed, pre-use configuration, a section of the first weakened region forms an angle with the first section of the hinge in a range from about 20° to about 70° and a section of the second weakened region forms an angle with the second section of the hinge in a range from about 20° to about 70°.

13. The container of claim 10, wherein at least a majority of the first weakened region is between the first section of the hinge and the lid or the base, and wherein at least a majority of the second weakened region is between the second section of the hinge and the lid or the base.

14. The container of claim 10, wherein, when the container is in the closed pre-use configuration, the tab extends from the lid extension; and wherein, after the container is opened by tearing along the weakened regions, a first portion of the lid extension remains connected to the first portion of the hinge and a second portion of the lid extension remains connected to the second portion of the hinge.

15. The container of claim 10, wherein, when the container is in the closed pre-use configuration, the tab extends from the base extension; and wherein, after the container is opened by tearing along the weakened regions, a first portion of the base extension remains connected to the first portion of the hinge and a second portion of the base extension remains connected to the second portion of the hinge.

16. The container of claim 7, wherein, when the container is in the closed, pre-use configuration, the tab is between the first weakened region and the second weakened region.

17. The container of claim 7, wherein, when the container is in the closed, pre-use configuration, a section of the first weakened region and a section of the second weakened region are approximately parallel with the hinge.

18. The container of claim 7, wherein, when the container is in the closed pre-use configuration, the container is opened by simultaneously pulling, in opposite directions, the tab and either the first section of the hinge or the second section of the hinge.

19. The container of claim 7, wherein, when the container is resealed with the lid recoupled to the base, the first bump presses against the first portion of the same extension from which the tab extends and second bump presses against the second portion of the same extension from which the tab extends.

20. A tamper-evident container comprising:

a base comprising a base extension, the base extension having a first end opposite from a second end;

a lid comprising a lid extension, the lid extension having a first end opposite from a second end;

a hinge, wherein the base extension connects the base to the hinge, wherein the lid extension connects the lid to the hinge, and wherein the hinge has a first section opposite from a second section; and a tab extending from the lid extension;

wherein, when the container is in a closed, pre-use configuration with the lid coupled to the base, the tab comprises a free edge that defines an outermost perimeter of the tab between a first end and a second end;

wherein, when the container is in the closed, pre-use configuration, the tab extends in a direction away from the lid and the base such that the tab extends beyond the hinge;

wherein, when the container is in the closed, pre-use configuration, the first end of the free edge of the tab transitions to a first weakened region that is integral with the lid extension, and the second end of the free edge of the tab transitions to a second weakened region that is integral with the lid extension;

wherein the hinge is not coaxially aligned with the free edge of the tab, the first weakened region, or the second weakened region;

wherein, when the container is in the closed, pre-use configuration, the container is opened by tearing along the weakened regions to the first and second ends of the lid extension such that the lid and the base are separated;

wherein, when the container is in the closed, pre-use configuration, the lid extension comprises a first portion adjacent to the first weakened region that remains connected to the first section of the hinge after the first weakened region has been torn and comprises a second portion adjacent to the second weakened region that remains connected to the first section of the hinge after the first weakened region has been torn;

wherein the base extension comprises a first opposing portion and a second opposing portion, the first opposing portion has a first bump and the second opposing portion has a second bump;

wherein, when the container is in the closed, pre-use configuration, the first bump extends toward the first portion of the lid extension, and the second bump extends toward the second portion of the lid extension; and wherein the first portion and the second portion are each sized to be grasped between a thumb and finger of a user's first hand, and wherein the tab is sized to be grasped between a thumb and finger of a user's second hand such that the container is opened by simultaneously pulling, in opposite directions, the tab and either the first portion or the second portion of the lid extension.

21. The container of claim 20, wherein, when the container is in the closed, pre-use configuration, the first section of the hinge is intersected by the first weakened region and the free edge of the tab at the first end of the free edge of the tab, and the second section of the hinge is intersected by the second weakened region and the free edge of the tab at the second end of the free edge of the tab.

22. The container of claim 20, wherein, when the container is in the closed, pre-use configuration, the first section of the hinge is traversed by the free edge of the tab and the second section of the hinge is traversed by the free edge of the tab.

23. The container of claim 20, wherein, when the container is in the closed, pre-use configuration with the lid coupled to the base, the tab is between the first section of the hinge and the second section of the hinge.

24. The container of claim 20, wherein, when the container is in the closed, pre-use configuration, a section of the free edge of the tab forms an angle with the first section of the hinge in a range from about 110° to about 170° and another section of the free edge of the tab forms an angle with the second section of the hinge in a range from about 110° to about 170°; and wherein, when the container is in the closed, pre-use configuration, a section of the first weakened region forms an angle with the first section of the hinge in a range from about 20° to about 70° and a section of the second weakened region forms an angle with the second section of the hinge in a range from about 20° to about 70°.

25. The container of claim 20, wherein at least a majority of the first weakened region is between the first section of the hinge and the lid, and wherein at least a majority of the second weakened region is between the second section of the hinge and the lid.

26. The container of claim 20, wherein, when the container is resealed with the lid recoupled to the base, the first bump presses against the first portion of the lid extension and second bump presses against the second portion of the lid extension.

* * * * *